US010105278B2

(12) United States Patent
Bernhardt et al.

(10) Patent No.: US 10,105,278 B2
(45) Date of Patent: Oct. 23, 2018

(54) APPARATUS FOR AIDING MOBILITY OF A USER

(71) Applicant: TechRev Design Group Inc., Surrey (CA)

(72) Inventors: David Michael Bernhardt, Surrey (CA); Mark Kennith Longley, Surrey (CA)

(73) Assignee: Techrev Design Group Inc.

( * ) Notice: Subject to any disclaimer, the term of this patent is extended or adjusted under 35 U.S.C. 154(b) by 0 days.

(21) Appl. No.: 15/730,821

(22) Filed: Oct. 12, 2017

(65) Prior Publication Data

US 2018/0200137 A1 Jul. 19, 2018

(30) Foreign Application Priority Data

Jan. 17, 2017 (CA) ..... 2955102

(51) Int. Cl.

| | |
|---|---|
| ***A45B 3/02*** | (2006.01) |
| ***A61H 3/02*** | (2006.01) |
| ***A45B 3/00*** | (2006.01) |
| *A45B 9/00* | (2006.01) |

(52) U.S. Cl.

CPC ..... *A61H 3/02* (2013.01); *A45B 3/00* (2013.01); *A45B 2009/007* (2013.01); *A61H 2003/0233* (2013.01)

(58) Field of Classification Search

CPC ..... A45B 3/00; A45B 9/02; A45B 2009/007; A45B 1/00; A45B 1/04; A45B 3/12; A61H 3/02

USPC ..... 135/65–66, 68–69, 72, 75, 76

See application file for complete search history.

(56) References Cited

U.S. PATENT DOCUMENTS

| | | | | |
|---|---|---|---|---|
| 1,375,912 | A | 4/1921 | Huddle | |
| 2,590,607 | A * | 3/1952 | Grimball | A45B 3/00 135/69 |
| 4,556,075 | A | 12/1985 | Hoffman | |
| 4,809,725 | A * | 3/1989 | Channpigny | A61H 3/02 135/75 |
| 6,386,216 | B1 * | 5/2002 | Cubelli | A61H 3/02 135/66 |
| 6,527,321 | B1 * | 3/2003 | Kuciauskas | A45B 3/00 135/66 |
| 6,834,660 | B1 * | 12/2004 | Van Wart, Jr. | A61H 3/02 135/72 |
| 7,007,704 | B2 | 3/2006 | Luckstead | |

(Continued)

*Primary Examiner* — Winnie Yip

(74) *Attorney, Agent, or Firm* — Adrian D. Battison; Ade & Company Inc.; Ryan W. Dupuis

(57) ABSTRACT

An apparatus for aiding mobility of a user comprises inner and outer shafts each having a grip projecting transversely therefrom. The inner shaft is receivable in the hollow outer shaft and a locking mechanism is provided for securing the inner shaft in fixed relation to the outer shaft in a manner providing a plurality of configurations of the apparatus. Generally speaking, the configurations of the apparatus include a nested configuration in which the inner shaft is substantially entirely received in the outer shaft so as to present the grips in close proximity to one another, and an extended configuration in which the inner shaft projects along an axis of the apparatus beyond a top of the outer shaft so that the grips are in axially spaced relation. The inner and outer shafts may also be separated so that each forms a separate cane for use in one hand of the user.

13 Claims, 20 Drawing Sheets

(56) References Cited

U.S. PATENT DOCUMENTS

| | | | | |
|---|---|---|---|---|
| 7,360,548 | B1 * | 4/2008 | Hinca | A61H 3/02 135/65 |
| 8,439,057 | B2 * | 5/2013 | Parry | A45B 9/02 135/66 |
| 9,192,213 | B2 * | 11/2015 | Lin | A45B 9/00 |
| 2006/0118154 | A1 | 6/2006 | David | |
| 2015/0216272 | A1 * | 8/2015 | Paybins | A45B 3/00 135/66 |

* cited by examiner

A
28A
28

30
18
18B
36

6
6
29B
29A
10

28
18
36
15
A
14
12

28A
18B
28
18
36
12
15
14
14A
15
14

A
29B
28A
29A
24B
28B
28
31
31
CI
22
24A
19B
18A
18B
19A
18
12
CO
14A
A 29B
28
31
29A
24A
A
17
19B
14B
18
19A

A
12
18
18A
18B
19A
19B
19B
28
28A
28B
29A 28
18
76
72
75
39
40
32
13A
22
A
57
23A
DW
45
36
1
UP
12
31
51
73
38A
38B 28
22
18
59
24A
17
14A
27
62B
13B
22
12
62A
61
31
32E
59
13A
13B

36'
12

36'
12

36'
12

79
28
102
41
78
18
90
92
36"
51
22
31
12
32
87
94A
94B

APPARATUS FOR AIDING MOBILITY OF A USER

This applications claims the benefit of Canadian Patent Application 2,955,102 filed Jan. 17, 2017.

FIELD OF THE INVENTION

The present invention relates generally to mobility aids, and more particularly to an apparatus forming such an aid which can be arranged in a plurality of configurations depending on mobility of the user.

BACKGROUND

Single use mobility aids such as canes, crutches, walking sticks and the like, provide support in strictly delimited situations. No known single mobility aid provides versatile support in all situations that would be commonly encountered by a mobility limited individual. For example, a cane supports someone with a disability on one side, but if they lean too far to the other side, they can lose their balance and fall. Using two canes solves this particular problem, but two canes monopolize both hands because they are always needed for support. When one desires to have one hand free, one is forced to hold two canes in one hand (not always the safest way to support), and one is liable to drop both canes, creating the problem of having to retrieve the dropped canes when already in a diminished physical capacity.

Some attempts to create two-in-one cane solutions include U.S. Pat. No. 4,556,075 to Hoffman comprising rounded (crook, hook) handle canes one of which forms an outer shell which opens longitudinally of the cane's shaft axis to form two halves so that an inner cane may be removed from inside.

In U.S. Pat. No. 1,375,912 to Huddle an inner cane slides axially inside a hollow shaft and there is provided a handle cover for receiving over a handle of the inner cane and connecting to the hollow shaft at its top to form a single cane. As in the Hoffman, in Huddle there is thus provided two canes, one of which is hollow, that can be arranged to collectively form a single cane or which can be separated so as to have two canes.

In US Publication 20060118154 to David is provided an apparatus generally forming a crutch from which a hand-held cane may be formed by rearranging in a cane configuration only some of the parts of the apparatus.

In U.S. Pat. No. 7,007,704 to Luckstead is an assembly comprising a pair of canes which can be connected in side-by-side fashion for use as a single cane or which can be detached or separated so that one of the cane can be used in each hand of the user.

SUMMARY OF THE INVENTION

It is an object of the present invention to provide a versatile apparatus for aiding mobility of a user.

According to an aspect of the invention there is provided a set of two canes that can be combined seamlessly to cooperate efficiently and safely in the form of a single interconnected structure, yet can be deployed quickly and easily for use as two separated canes. Desirably each individual cane is structurally safe to use in all situations, with no protrusions or exterior hazards. Preferably these canes employ an ergonomic T-handle (Derby handle) so that the user has more control over the cane(s) with less physical strain. Also preferably the canes can be arranged securely in various configurations as required by the user to aid his/her mobility.

According to another aspect of the invention there is provided for a user adjustable, safe and easy use of a single cane, two equally useful canes, forearm crutch or a two handled stand-up cane, all in one device. The canes can be locked securely in their various configurations, and converted from one configuration to another quickly, safely and simply. The canes are each built as structurally sound support devices that interlock with each other as needed, yet can be used separately without fear that they could crumple under excess weight or unanticipated side forces. The canes will employ ergonomic handle designs that reduce fatigue and prevent unsafe loss of control. The locking and release mechanism is intuitive and reliable, and allows the user to switch between configurations easily and safely.

According to another aspect of the invention there is provided an apparatus for aiding mobility of a user comprising:

an outer shaft which is hollow extending along an axis of the apparatus from a ground engaging end at a bottom of the outer shaft to a top end where there is located a grip projecting from the outer shaft transversely to the axis;

an inner shaft receivable in the outer shaft along said axis and having a bottom end locatable in the outer shaft at a location axially intermediate the top end and the ground engaging end and an upper end of the inner shaft at which there is located a grip located externally of the outer shaft that projects transversely from the inner shaft;

a locking mechanism for securing the inner shaft in fixed relation to the outer shaft so that the apparatus is usable in a plurality of configurations including:

- a nested configuration in which the inner shaft is received substantially entirely in the outer shaft with the grip which is coupled to the inner shaft being located in contact with or immediately adjacent in close proximity to the grip coupled to the outer shaft;
- an extended configuration in which the grip coupled to the inner shaft is spaced in an axial direction from the grip coupled to the outer shaft so that the inner shaft extends axially outwardly past the top end of the outer shaft;

the locking mechanism being formed by a plurality of apertures in the inner shaft and an aperture in the outer shaft where there is located a retention element for passing through said aperture and seating in one of the plurality of apertures in the inner shaft, such that:

- (i) in the nested configuration a first one of the apertures in the inner shaft is aligned with the aperture axially and angularly of the axis so that the retention element is insertable therethrough for securing the inner and outer shafts in the nested configuration;
- (ii) in the extended configuration a second one of the apertures in the inner shaft, which in relation to the first aperture is closer to the bottom end of the inner shaft, is aligned with the aperture axially and angularly of the axis so that the retention element is insertable therethrough for securing the inner and outer shafts in the extended configuration.

Preferably the nested configuration comprises a cane configuration in which the grip which is coupled to the inner shaft and that coupled to the outer shaft are in abutment one top of the other and projecting from the apparatus axis in a common direction so as to collectively form a cane handle which is contiguous about its circumference.

The grip which is coupled to the outer shaft may include a ridge and the grip which is coupled to the inner shaft may include a cooperative recess for matingly receiving the ridge so as to resist pivoting of the inner shaft relative to the outer shaft in the cane configuration.

Preferably the nested configuration comprises a two handled configuration in which the grip which is coupled to the inner shaft and that coupled to the outer shaft project from the apparatus axis in different transverse directions so as to provide separate gripping surfaces each for one hand of the user.

The nested two handled configuration may be useful for helping the user raise his/her body for example to get out of a seated position on a chair seat by propping the body up using the apparatus. In this configuration the apparatus forms a central post substantially defined by the outer shaft with the inner shaft received substantially wholly therein and with one hand grip presented on either side of the central post so that weight of the user may be transferred to the apparatus in a balanced manner which resists the apparatus from tipping over.

Preferably the extended configuration comprises a crutch configuration in which the grip which is coupled to the inner shaft and that coupled to the outer shaft project from the apparatus axis in a common direction such that the grip coupled to the inner shaft is for resting against an arm pit of the user and the grip coupled to the outer shaft is for gripping with a hand of the user.

Preferably the extended configuration comprises a two handled configuration in which the grip which is coupled to the inner shaft and that coupled to the outer shaft project from the apparatus axis in different transverse directions for providing separate gripping surfaces each for one hand of the user at spaced positions angularly and axially of the axis.

That is, the apparatus in the extended two handled configuration forms a central post defined by the outer shaft and the inner shaft telescoped therebeyond with one hand grip presented on either side of the central post and in spaced axial relation to one another which is useful to help the user raise his/her body for example to get out of the seated position on the chair seat as the user can with their hands climb up the apparatus.

Preferably the apparatus is configurable in a separated configuration in which the inner shaft is wholly outside of the outer shaft such that the inner shaft and grip coupled thereto and the outer shaft and grip coupled thereto each form a separate cane for use in a respective hand of the user.

In one arrangement the retention element comprises a bearing supported for rolling movement in a cavity of a carrier which is carried externally of the outer shaft for movement relative thereto, the cavity of the carrier being shaped so that in a locking position the bearing is held in a location relative to the apparatus axis at which the bearing is seated in one of the apertures of the inner shaft and in an unlocking position the bearing is enabled to roll along a surface of the inner shaft.

For example the bearing is a ball bearing.

The carrier may be slidable axially along the outer shaft.

The carrier may be rotatable axially about the outer shaft.

Preferably at an edge defining each one of the apertures in the inner shaft there is formed a ramped surface upon which the bearing may roll out of seated position in the respective aperture in the inner shaft.

In another arrangement the retention element comprises a projecting element carried by a biasing element which is supported at a fixed location inside the inner shaft arranged to bias the projecting element outwardly from the apparatus axis.

In a further arrangement the retention element comprises a pin biased by an arrangement located outside the outer shaft in a direction inwardly towards the apparatus axis.

BRIEF DESCRIPTION OF THE DRAWINGS

Arrangements of the invention will now be described in conjunction with the accompanying drawings in which:

FIG. 4*a* illustrates in side elevation the apparatus in a crutch configuration, while

FIG. 11*a* illustrates in vertical cross-section as if it were taken along line 6-6 in FIG. 1*b* a second arrangement of locking mechanism, while FIG. 11*b* shows an enlarged view of a portion of the arrangement of locking mechanism depicted in FIG. 11*a;*

FIG. 12*a* illustrates in vertical cross-section as if it were taken along line 6-6 in FIG. 1*b* the apparatus in an extended two handled configuration, while FIG. 12*b* shows an enlarged view of a portion of the apparatus as depicted in FIG. 12*a;*

In the drawings like characters of reference indicate corresponding parts in the different figures.

DETAILED DESCRIPTION

Figures 1A, 1B, 1C, 1D:
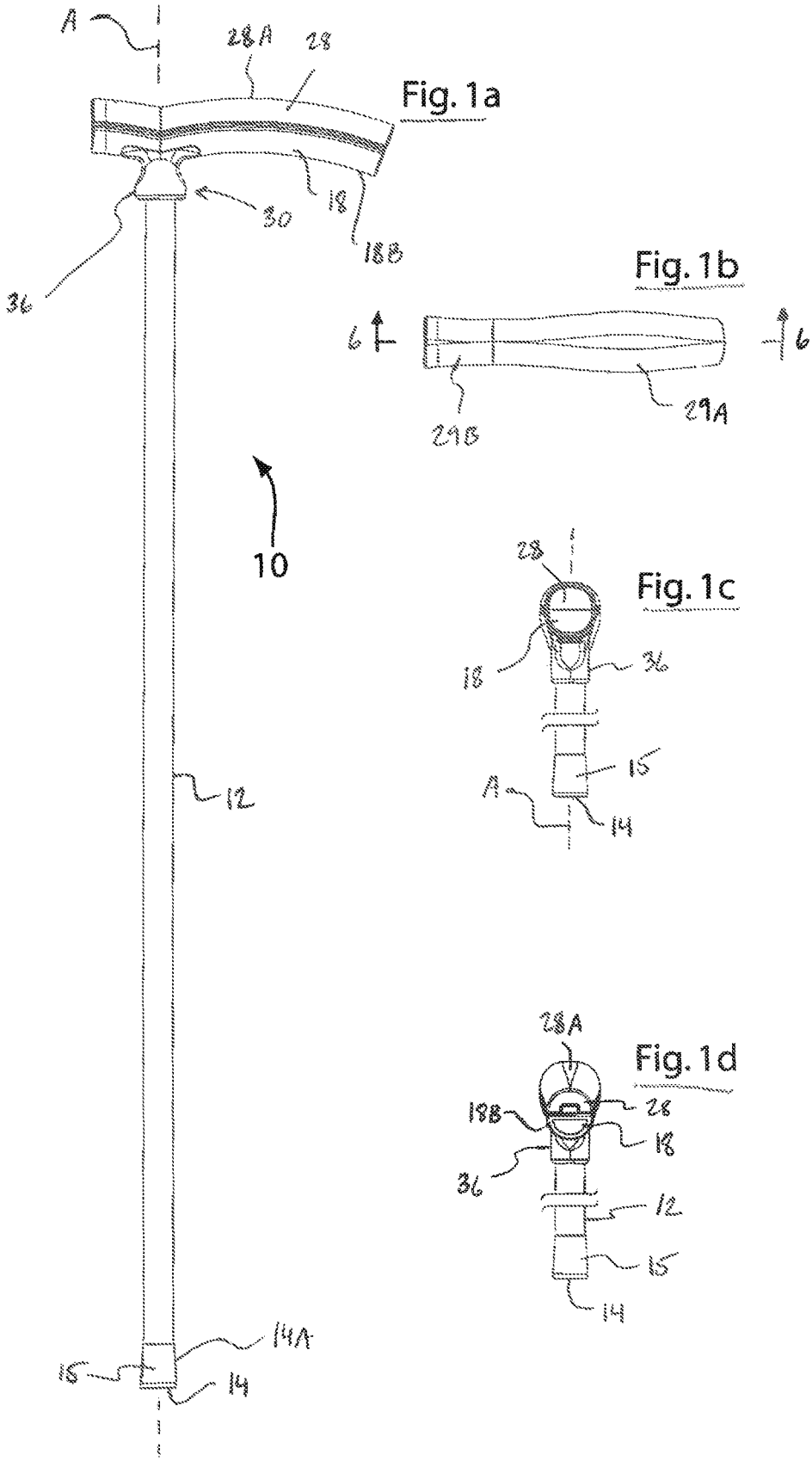
FIGS. 1*a*-1*d* illustrate an apparatus according to an arrangement of the present invention in side elevational, top plan, front and back elevational views, respectively.

There is illustrated in the accompanying figures an apparatus 10 for aiding mobility of a user. As will be described in more detail shortly the apparatus can be arranged in a plurality of working configurations, each one of which may have further variations within a general one of the working configurations, so that a single such apparatus may be provided but which is versatile for satisfying various wishes of the user particularly as they relate to the users mobility.

Generally speaking the apparatus 10 comprises a hollow outer shaft 12 extending along an axis A of the apparatus from a ground engaging end 14 at a closed bottom 14A of the outer shaft to an open top end 14B communicating with the hollow interior 17 of the outer shaft. At the top end there is provided a grip 18 which in the illustrated arrangement is that of a Derby style. The grip 18 projects radially transversely from the outer shaft so as to be radially transverse to the apparatus axis A. At the bottom 14A of the outer shaft there is provided a gripping end cap 15 comprising gripping material such as rubber for providing greater friction when engaging a support surface, whether it be a floor in an interior of a building or a ground surface exterior of a building.

Further to the hollow outer shaft there is an inner shaft 22 which is receivable in the hollow interior 17 of the outer shaft 12 along the apparatus axis A. The inner shaft 22 has a closed bottom end 24A which, when the inner shaft is received in the outer shaft, is located axially intermediate the ground engaging end 14 and the top 14B of the outer shaft. The inner shaft extends linearly from its bottom end 24A to a top or upper end 24B whereat there is located a grip 28 which is located externally of the outer shaft even when the inner shaft is received substantially wholly in the outer shaft. The grip 28 which is coupled to the inner shaft projects radially transversely from the inner shaft 22.

The inner shaft 22 is slidable axially within the hollow interior 17 of the outer shaft 12 such that the inner shaft is arranged for telescopic extension beyond the open top 14B of the outer shaft, and a locking mechanism 30 is provided for securing the inner shaft in fixed relation to the outer shaft at a plurality of locations therealong so that the apparatus 10 is usable in the plurality of working configurations which will now be described in more detail.

The working configurations include:

(i) a nested configuration in which the inner shaft 22 is received substantially entirely in the outer shaft 12 with the grip 28 which is coupled to the inner shaft 22 being located in contact with or immediately adjacent in close proximity to the grip 18 coupled to the outer shaft; and (ii) an extended configuration in which the grip 28 coupled to the inner shaft is spaced in an axial direction, that is along the apparatus axis A, from the grip 18 coupled to the outer shaft so that the inner shaft 22 extends axially outwardly past the top end 14B of the outer shaft.

Figure 3A:
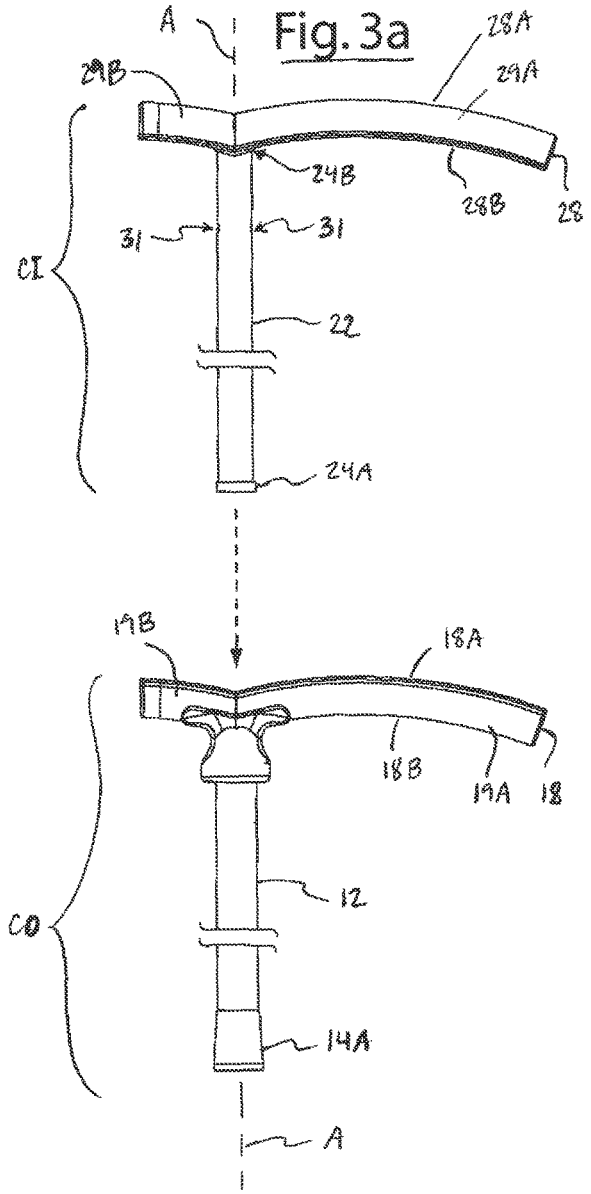
FIG. 3*a* illustrates in side elevation the apparatus with inner shaft removed from an outer shaft.
Figure 3B:
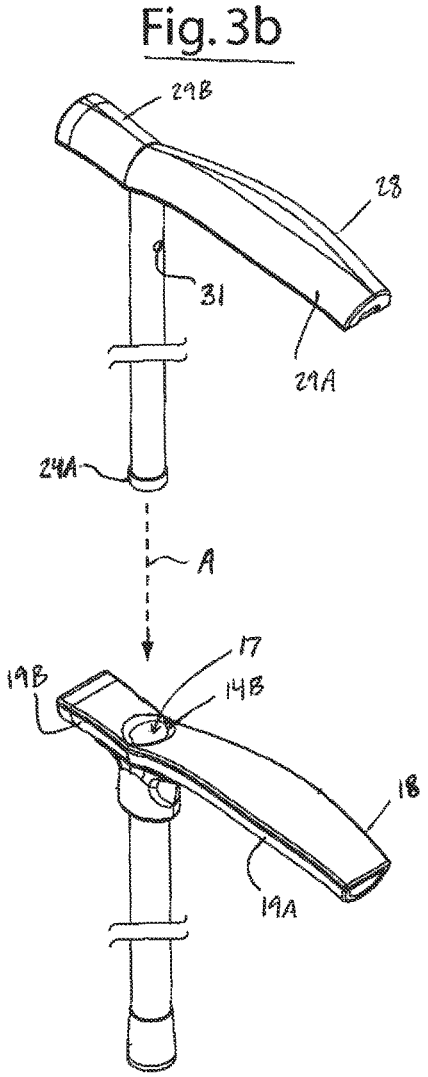
FIG. 3*b* shows an isometric view of same.

Another working configuration in which the apparatus may be arranged but which does not require the locking mechanism to secure the inner and outer shafts together is a separated configuration as shown in FIG. 3 in which the inner shaft 22 is wholly outside of the hollow outer shaft 12. In the separated configuration the inner shaft 22 and grip 28 coupled thereto and the outer shaft 12 and grip 18 coupled thereto each form a separate cane CI, CO for use in a respective hand of the user. Thus at the bottom 24A of the inner shaft there is provided a gripping end cap 25 comprising gripping material such as rubber for providing greater friction when engaging the support surface with the inner shaft when the apparatus is in the separated configuration.

Figure 2A:
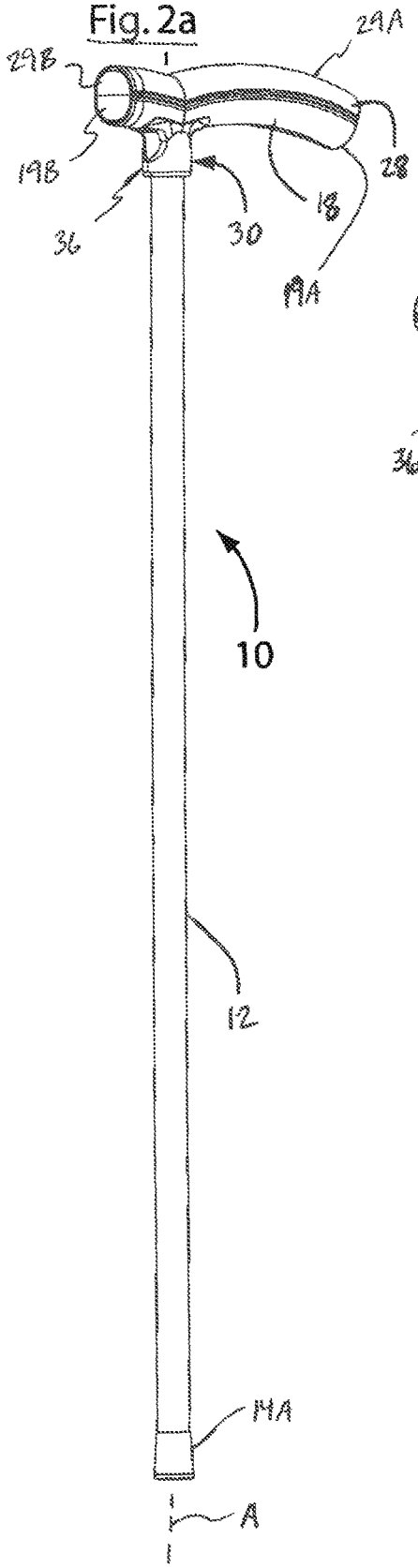
FIGS. 2*a*-2*c* illustrate the apparatus in isometric view from a front and one side, a top and the same side, and a rear and another side, respectively.
Figure 2B:
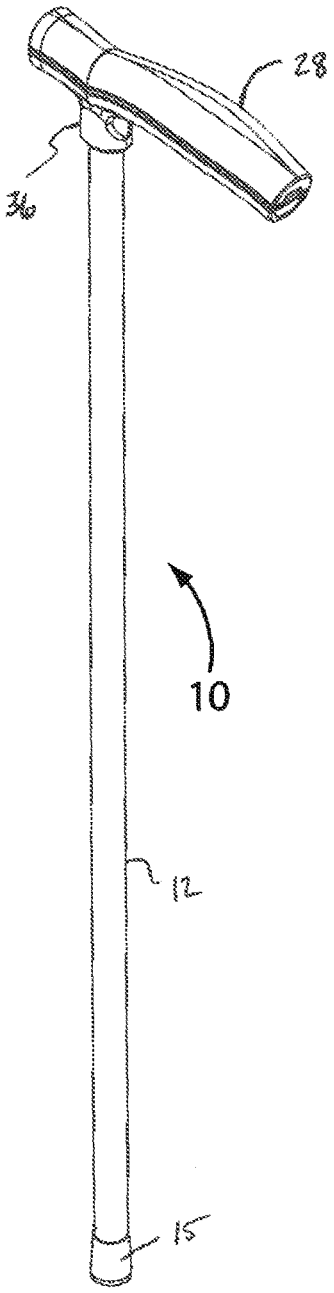
Figure 2C:
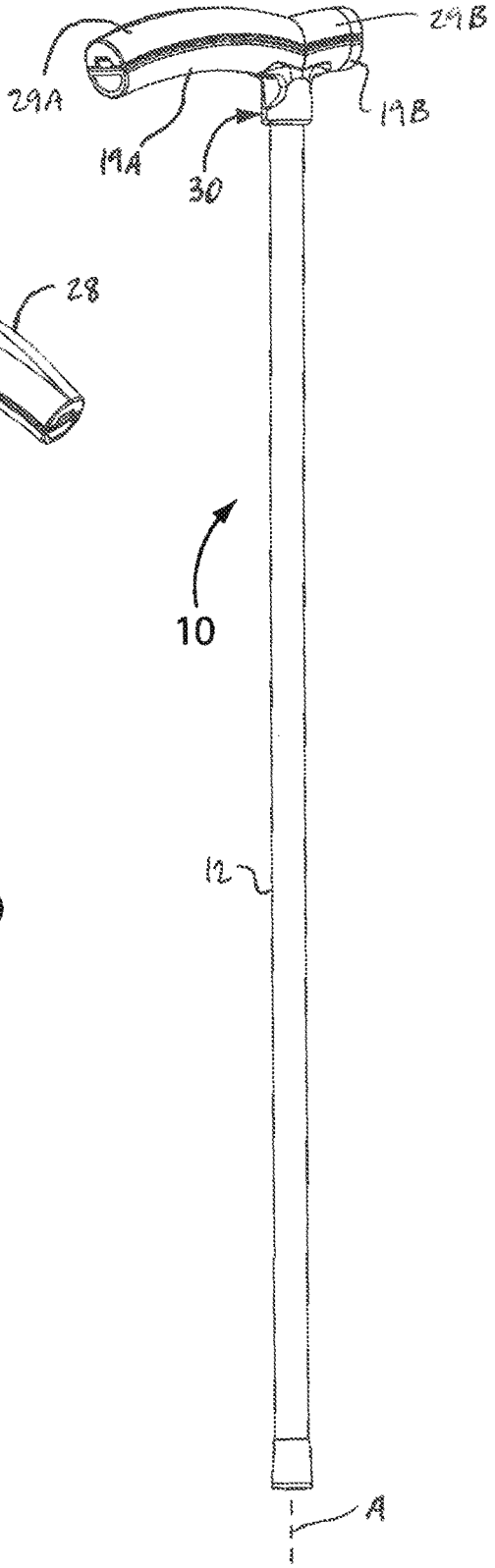

The nested working configuration of the apparatus 10 includes a cane configuration, more clearly shown in FIGS. 1 and 2, in which the grips 18 and 28 are in abutment with the grip 28 of the inner shaft on top of the grip 18 of the outer shaft so that the grips are abutting one another relative to the axial direction A. Further, the grips are oriented so as to project from the apparatus axis in a common radially transverse direction so as to collectively form a cane handle which is contiguous about its circumference which is taken transversely to the (radially) transverse direction in which the grips project from apparatus axis A. That is, a gripping surface of the single cane handle is formed substantially by a top 28A of the inner shaft's grip and by a bottom 18B of the outer shaft's grip.

Figure 10B:
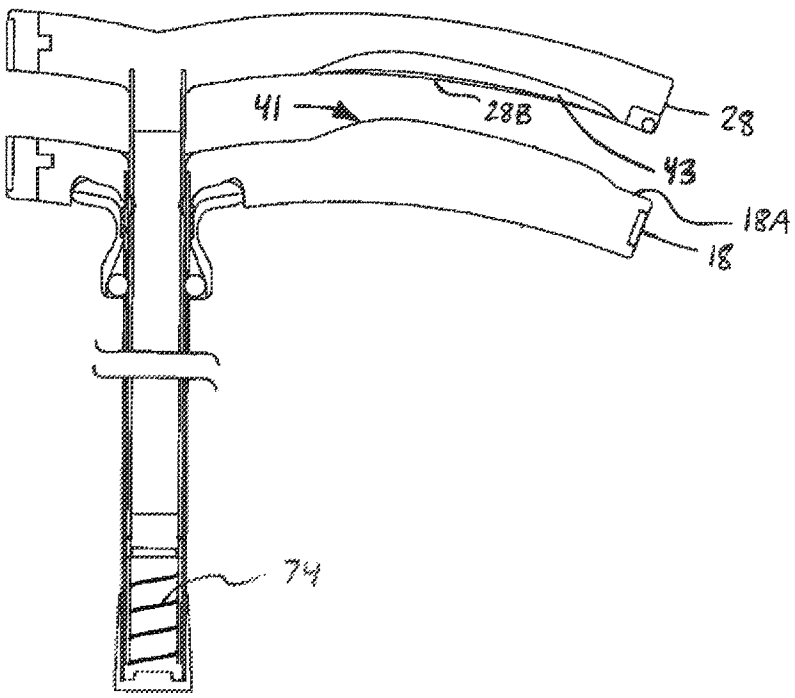
FIG. 10*b* shows the same view of the alternate versions with the grips spaced from one another.
Figure 10A:
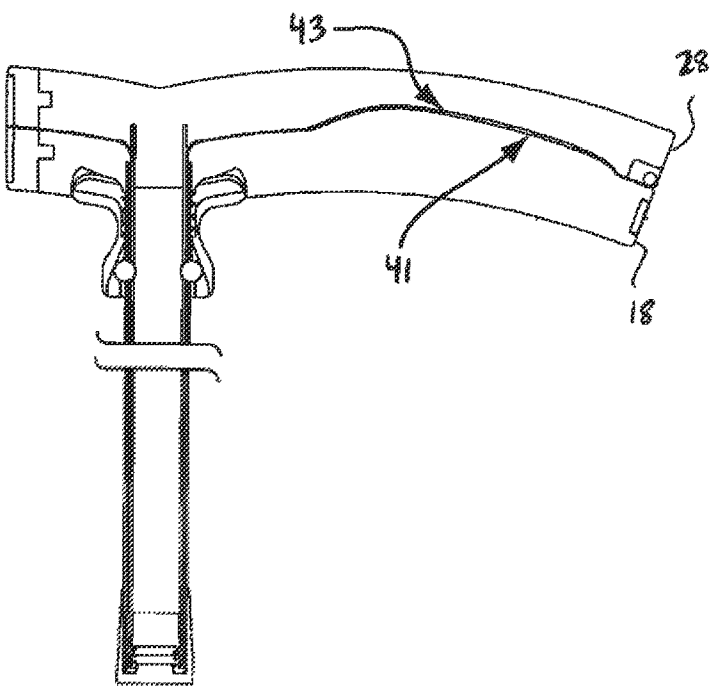
FIG. 10*a* illustrates in enlarged vertical cross-section as if it were taken along line 6-6 in FIG. 1*b* an alternate version of grip for each that is coupled to the respective one of the inner and the outer shaft.

Both a bottom 28B of the inner shaft's grip 28 and a top 18A of the outer shaft's grip 18 may comprise a smooth surface, or in an alternative arrangement of the grips as shown in FIG. 10 the outer shaft's grip 18 may comprise at its top a ridge 41 and at a bottom of the inner shaft's grip 28 a cooperative recess 43 for matingly receiving the ridge 41 so as to resist pivoting of the inner shaft relative to the outer shaft in the cane configuration which otherwise may cause misalignment of the apertures or and/or which may cause stress on the locking mechanism.

Figures 5A, 5B, 5C:
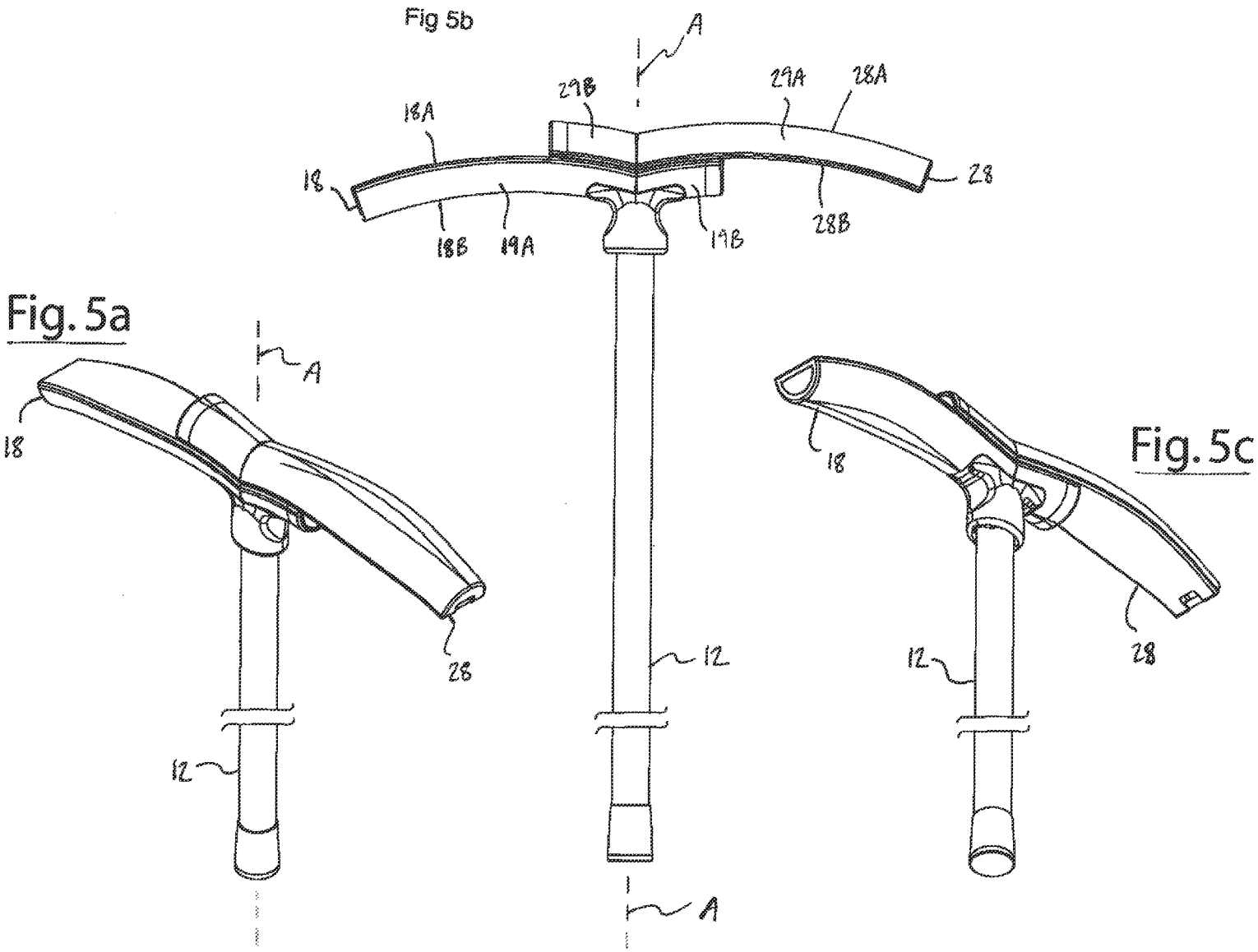
FIGS. 5*a*-5*c* show the apparatus in a two handed nested configuration in top isometric, side elevational, and bottom isometric views, respectively.

The nested working configuration also includes a two handled configuration, more clearly shown in FIG. 5, in which the grips 18, 28 project from the apparatus axis A in different radially transverse directions, which are spaced apart 180 degrees in the illustrated arrangement, such that there are provided separate gripping surfaces each for one hand of the user. That is, each of the grips 18, 28 may provide a continuous gripping surface about its respective circumference, that is there is a first gripping surface for one hand formed substantially by the top 18A and the bottom 18B of the outer shaft's grip and a second gripping surface for the other hand formed substantially by the top 28A and the bottom 28B of the inner shaft's grip. In the nested two handled configuration the apparatus is arranged so as to form a central post defined substantially by the outer shaft 12 as the inner shaft 22 is received substantially wholly therein, and the grips 18 and 28 present their respective gripping surfaces on either side of the central post spaced angularly of the axis A from one another, thereby forming a "T" shape.

In the illustrated arrangement the grips 18 and 28 of the outer and inner shafts 12 and 22 are in abutment in the nested two handled configuration because each grip 18, 28 has a smaller portion 19B, 29B on an opposite side of the apparatus axis A in relation to a larger portion 19A, 29A of the respective grip so that each smaller portion abuts the larger portion but of the opposite grip. In alternative arrangements where the grip is located solely to the side of a periphery of the shaft with no suitable surface for gripping provided at or immediately encompassing the shaft, the grips are located immediately adjacent in close proximity to one another.

Figure 4A:
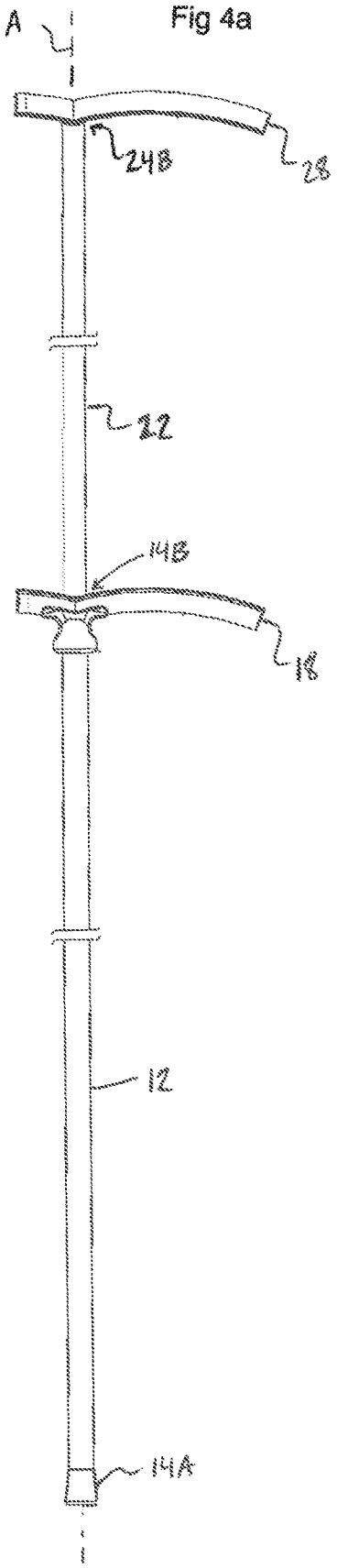
Figure 4B:
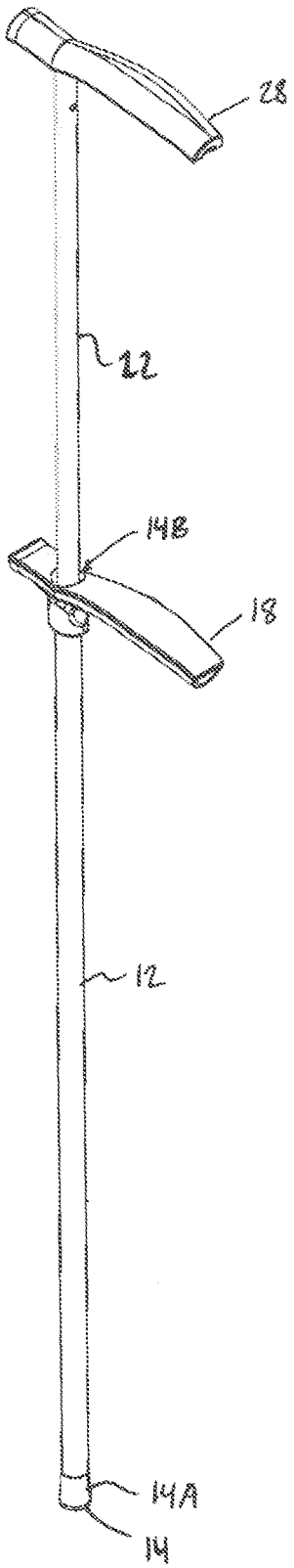
FIG. 4*b* shows an isometric view of same.
Figures 11A, 11B:
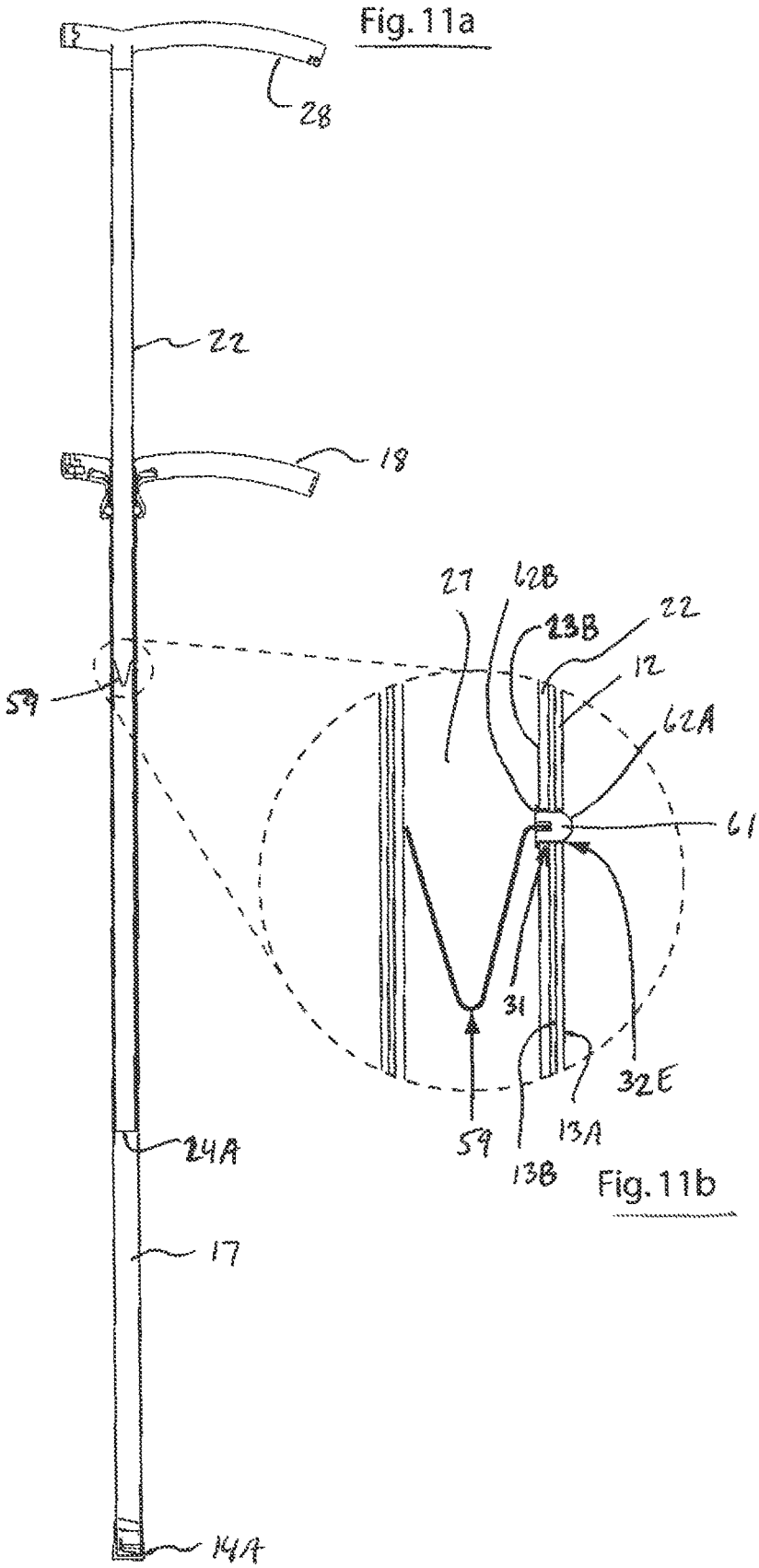

The extended working configuration of the apparatus 10 includes a crutch configuration, shown more clearly in FIGS. 4 and 11, in which the grips 18 and 28 are at axially spaced positions and oriented so as to project from the apparatus axis A in a common radially transverse direction such that the inner shaft's grip 28 is presented at a location suitable for resting up in against an arm pit of the user and the outer shaft's grip 18 is at a suitable location for gripping with a hand of the user.

Figures 12A, 12B:
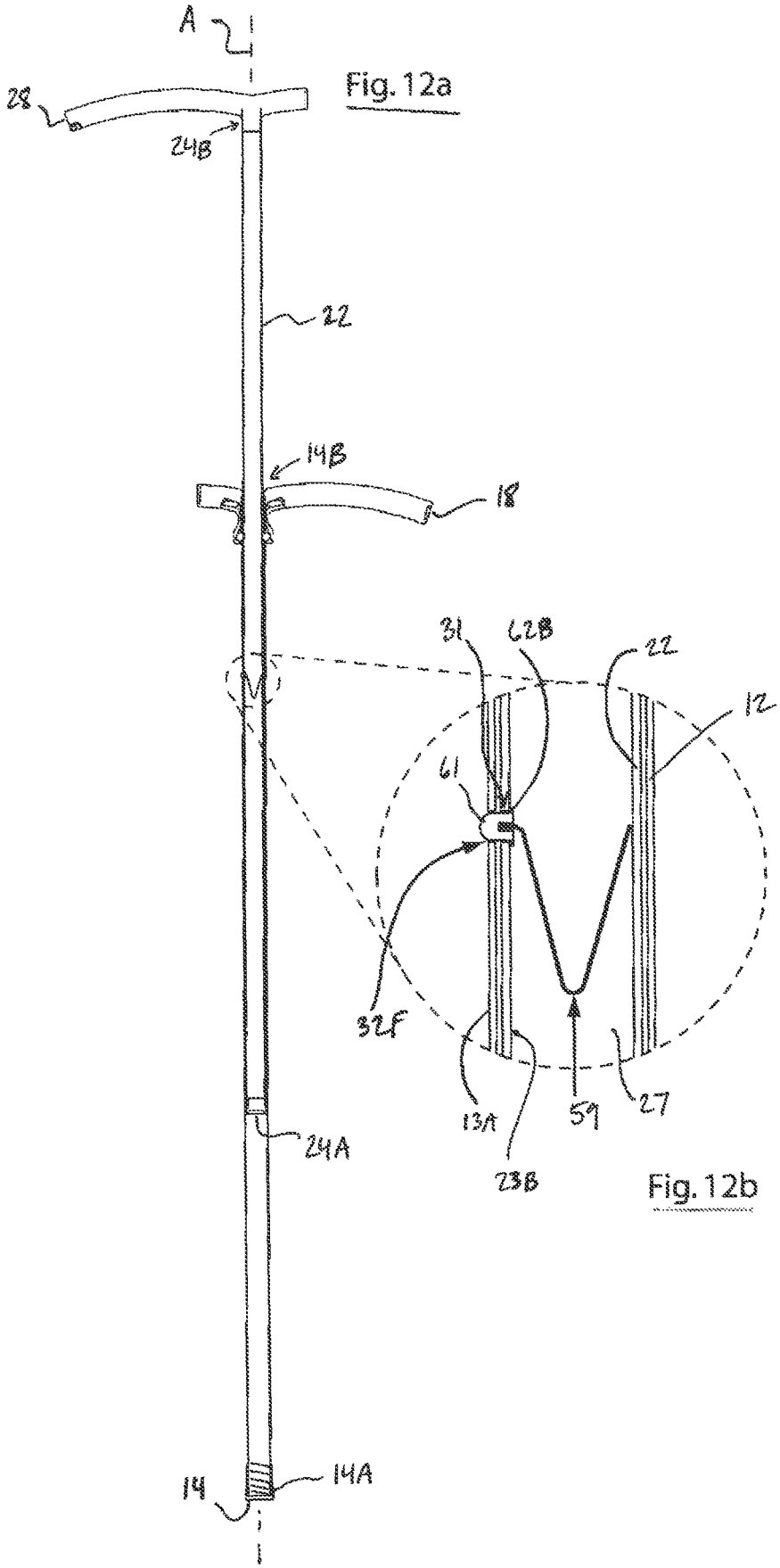
Figures 13A, 13B, 13C:
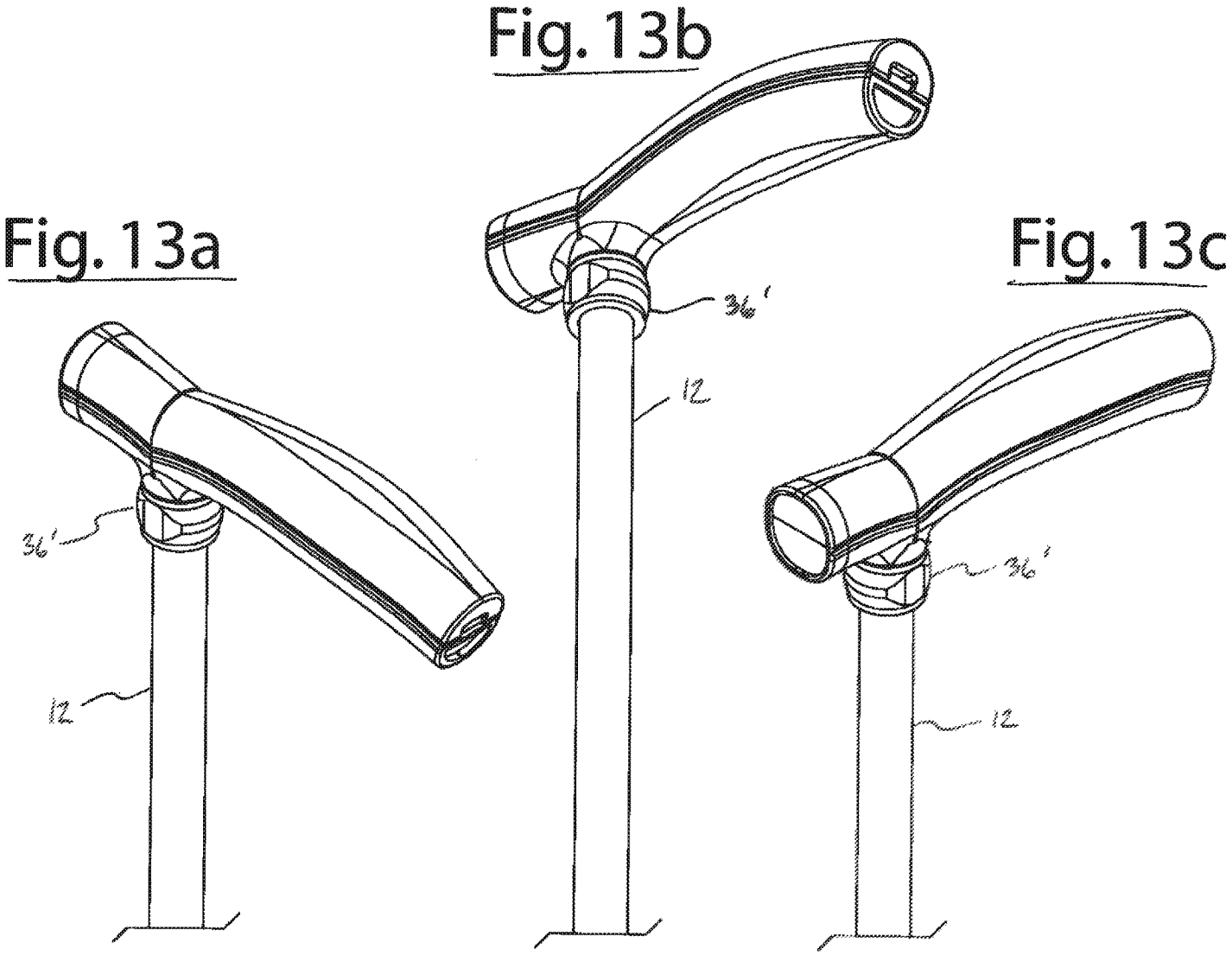
FIGS. 13*a*-13*c* illustrate the apparatus with a second arrangement of carrier for the locking mechanism shown specifically from top rear, bottom rear, and top front isometric views, respectively.
Figure 14A:
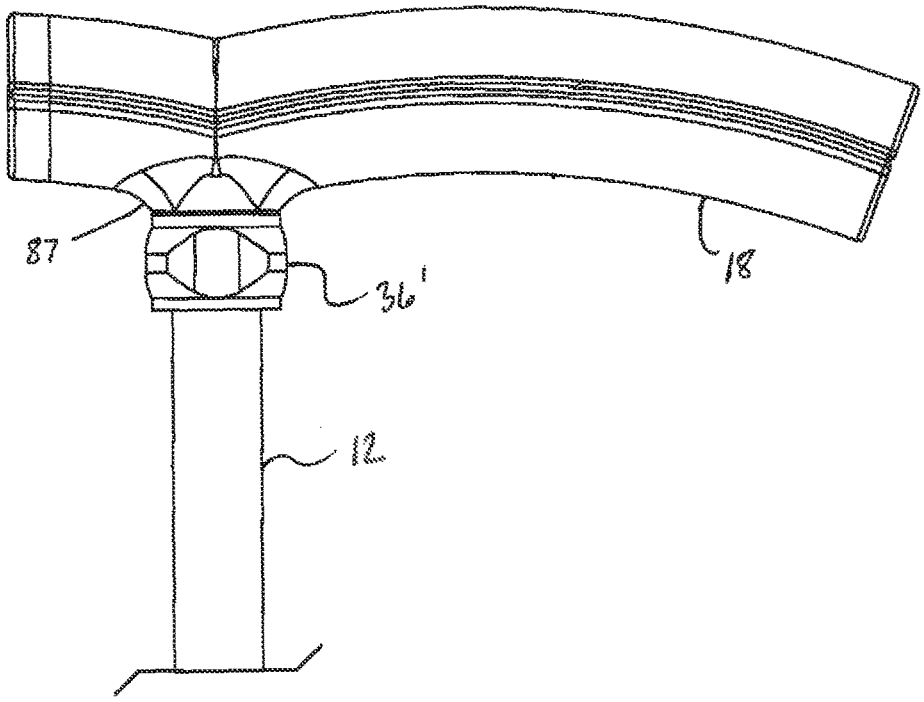
FIGS. 14*a* and 14*b* show the second arrangement of carrier in side elevational and vertical cross-sectional views, respectively, where the latter is as if it were taken along line 6-6 in FIG. 1*b;*
Figure 14B:
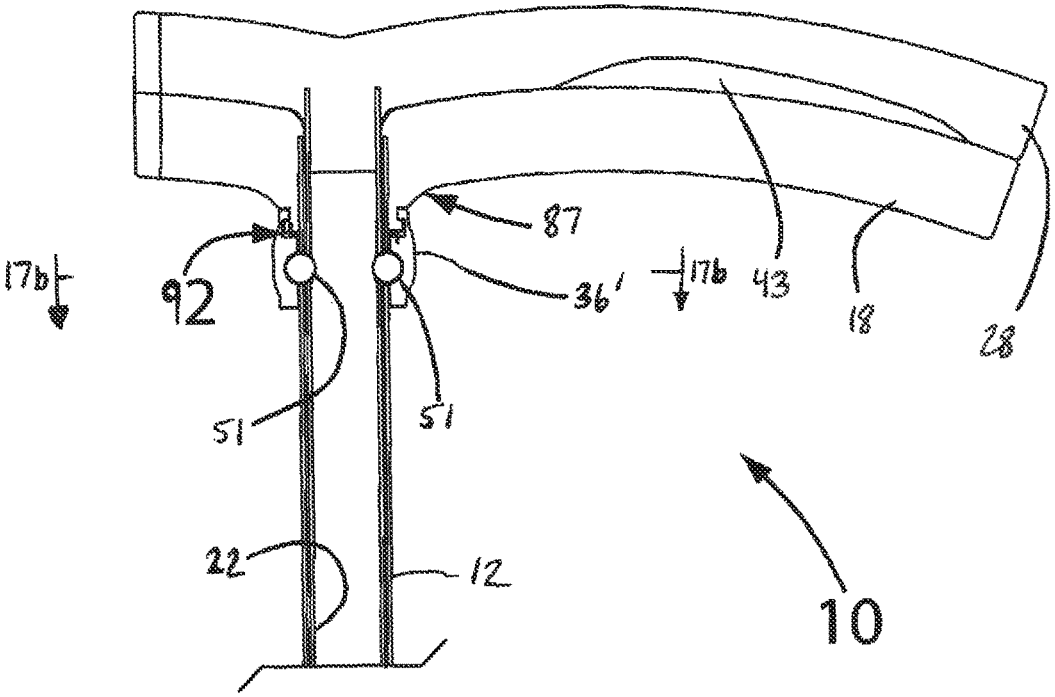
Figure 15B:
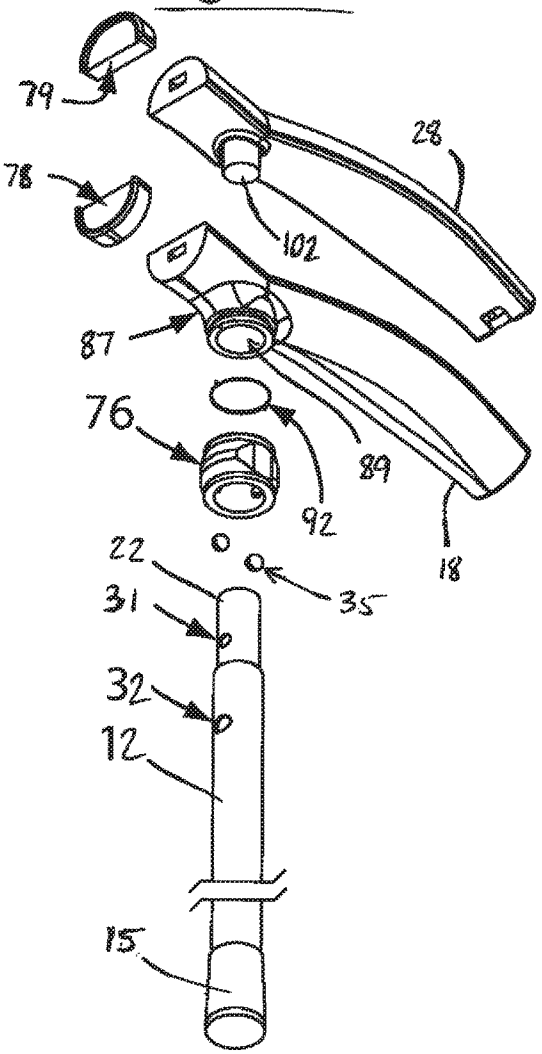
FIGS. 15*a* and 15*b* show exploded views of the apparatus with second arrangement of carrier in top front isometric and bottom front isometric views, respectively.
Figure 15A:
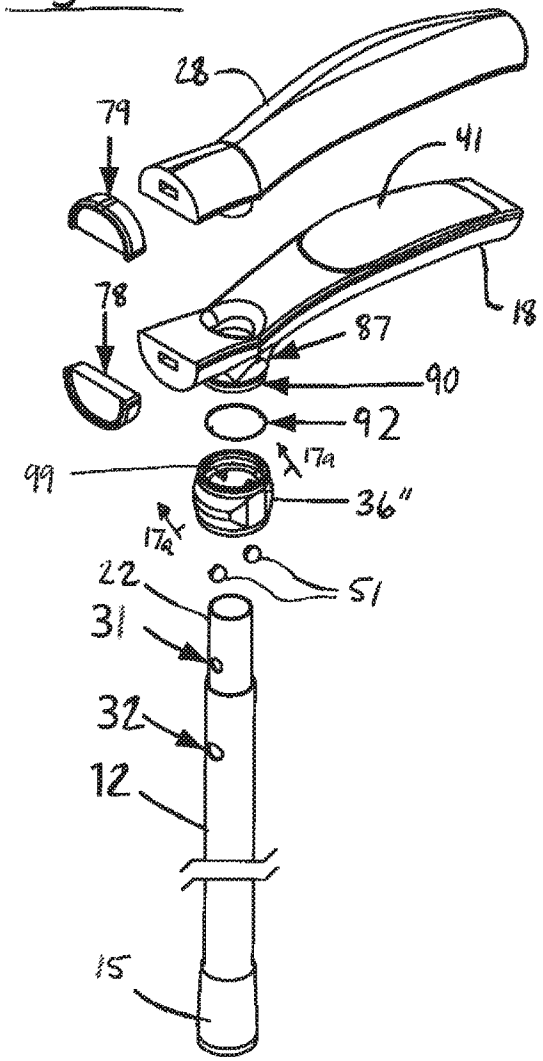

The extend working configuration also includes a two handled configuration, more clearly shown in FIG. 12, in which the grips 18 and 28 are at axially spaced positions and oriented so as to project from the apparatus axis A in different radially transverse directions, which are spaced apart 180 degrees in the illustrated arrangement. In this configuration there are thus provided separate gripping surfaces each for hand one of the user at positions which are spaced both angularly and axially of the apparatus axis A.

It will be appreciated that typically the outer shaft is sized in length along the axis A so that when the outer shaft is upstanding the grip 18 is presented at a hip height of the user. Thus, in the extended two handled configuration the apparatus is arranged to form the central post which in this configuration is defined by both the outer shaft 12 and the inner shaft 22 which extends along the apparatus axis A past the top 14B of the outer shaft, and the inner shaft's grip 28 on an opposite side of the axis A to the outer shaft's grip 18 is located at a height exceeding the hip height of the user so that the user can with the hands climb up the apparatus to raise his/her body to for example get out of a seated position on a chair seat. Typically in the crutch configuration the upper end 24B of the inner shaft is axially spaced from the top end 14B of the outer shaft by a smaller distance than a height or axial spacing between the outer shaft's top end 14B and its bottom 14A as an arm pit-to-hip height is typically smaller than a hip-to-ground height.

Once in the separated configuration the inner shaft 22 may be reinserted into the outer shaft 12 by guiding the inner shaft's bottom 24A through the open top 14A of the outer shaft into the hollow interior 17.

The locking mechanism 30 which secures the shafts in fixed relation to one another for those working configurations in which the inner shaft 22 is received inside the hollow outer shaft 12 is formed by a plurality of positioning apertures 31 in a surface of the inner shaft 22, a guide aperture 32 formed through a thickness of a peripheral wall of the outer shaft 12, and a retention element 35 which is located at the guide aperture 32 for passing therethrough and seating in one of the positioning apertures of the inner shaft.

More specifically, in the illustrated arrangements there are at least two positioning apertures in the inner shaft like those indicated at 31A and 31B which are at axially spaced positions so as to provide one nested working configuration of the apparatus and one extended working configuration. In order to secure the inner and outer shafts together in the desired configuration, one of the positioning apertures 31 is aligned with the guide aperture 32 angularly and axially of the apparatus axis A so that the retention element 35 may be inserted therethrough.

In order to provide a configuration in which the handles are projecting in different (radially) transverse directions and another in which the handles are projecting in a common direction, regardless of whether with the shafts nested or extended, at least two of the positioning apertures in the inner shaft like those indicated at 31A and 31C are spaced from one another angularly of the apparatus axis A so that the inner shaft 22 may be rotated relative to the outer shaft 12 with one of the positioning apertures still being presented at a location for alignment with the guide aperture and the retention element axially and angularly of axis A.

Figure 7:
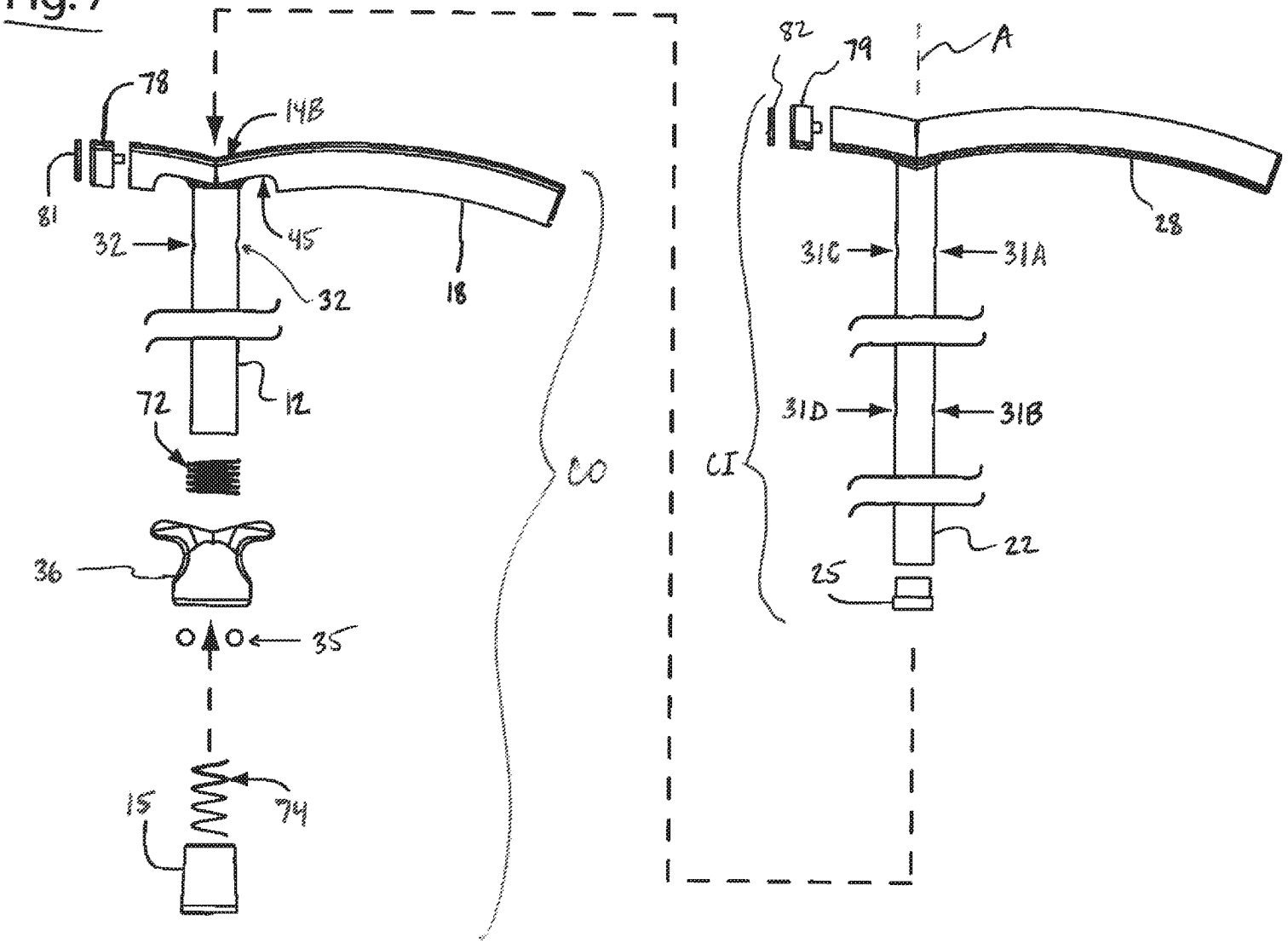
FIG. 7 shows an exploded view of the apparatus.
Figure 8E:
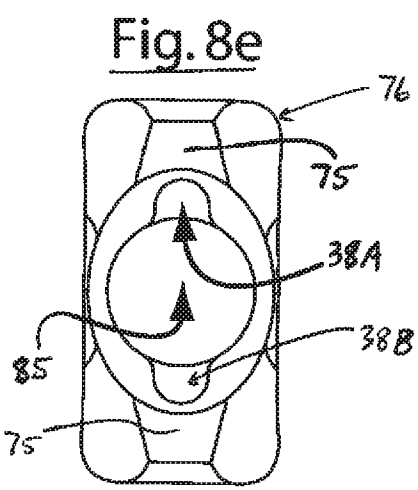
FIGS. 8*a*-8*f* show respective close-up views of a carrier of first arrangement of locking mechanism which is illustrated in FIGS. 6*a* and 6*b*, and specifically top isometric, bottom isometric, top plan, side elevational, and bottom plan views, and a cross-section taken along line 8*f*-8*f* in FIG. 8*c;*
Figure 8F:
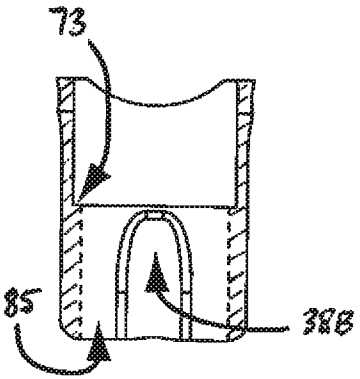
Figure 8C:
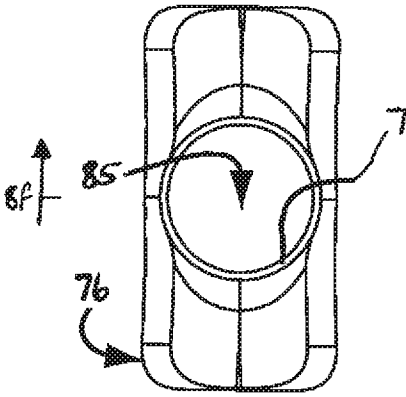
Figure 8D:
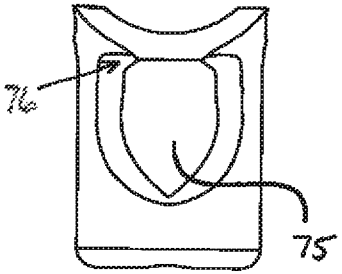
Figure 8A:
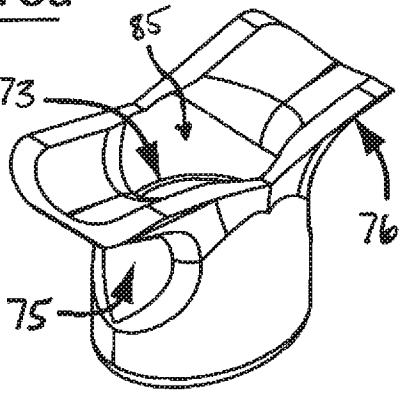
Figure 8B:
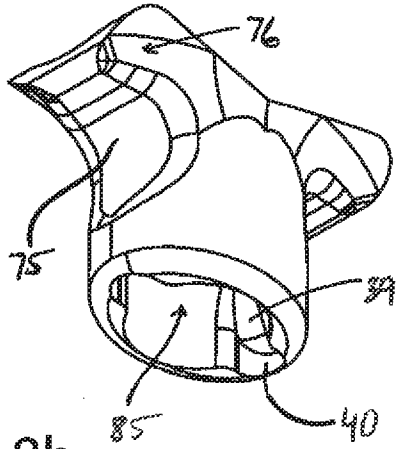

Thus there may be four positioning apertures 31A-31D in the inner shaft as shown in FIG. 7 to provide the four working configurations including nested cane, nested two handled, and extended crutch and two handled.

In some arrangements of the locking mechanism there is provided a carrier 36 which supports the retention element 35 in a position ready for passing through the aligned apertures of the shafts. In at least some of such arrangements the carrier includes a cavity 37 in which the retention element is carried for its movement between a locking position in which it passes through one of each type of apertures, that is through a positioning aperture 31 and through a guide aperture 32, and an unlocking position in which the retention element is located externally of at least one of the respective positioning and the guide apertures so as to not be passed through at least that one. In some arrangements the carrier 36 is carried externally of the outer shaft 12.

In a first arrangement shown more clearly in FIGS. 8 and 9 the carrier 36 is shaped so as to encompass the outer shaft 12 and is arranged for sliding movement axially along the outer shaft between locking and unlocked positions of the mechanism 30. In this first arrangement the retention element comprises a pair of ball bearings 51 cooperating with a pair of guide apertures 32 with each bearing contained in one of two interior cavities 38A and 38B. Each of the cavities 38A, 38B extends axially of the outer shaft and is shaped so that an outer wall 39 of the respective cavity which is distal to the outer shaft is inclined relative to an outer surface 13A of the outer shaft so that this outer wall 39 is ramped downwardly towards the bottom 14A of the outer shaft and outwardly from the outer surface 13A. There is also an end wall 40 of the respective cavity at an end of the inclined wall 39 where it is spaced furthest from the outer shaft's outer surface 13A. The end wall 40 is parallel to the outer surface 13A of the outer shaft.

Thus the bearings 51 are supported for rolling movement in the respective cavity 38A, 38B across the outer and end walls 39, 40. The bearings are located in fixed location to the outer shaft 12 by the guide apertures 32 and are otherwise sandwiched between the carrier 36 at the distal cavity walls and the inner shaft. As the cavities 38A, 38B at their end walls 40 provide more space radially from the outer shaft than at the inclined walls 39 the carrier 36 is slidably positioned, in the illustrated arrangement by displacing it upwardly towards the grip 18 as indicated by arrows UP (the user's fingers are illustrated at 1), so as to present the end walls 40 radially opposite the guide apertures 32. Thus the respective bearing 51 is enabled to roll along the surface 23A of the inner shaft in the unlocked position of the mechanism, allowing the inner shaft to be axially and angularly displaced within the outer shaft's hollow interior 17 for disposing the apparatus in the desired configuration.

With the inner shaft 22 located and oriented so as to provide the desired configuration the carrier 36 is slidably positioned, in the illustrated arrangement by displacing it downwardly towards the ground engaging end 14 as indicated by arrows DW, so as to present the inclined walls 39 radially opposite the guide apertures whereat there is less space radially between the outer shaft and the distal walls of the respective cavity 38A, 38B causing the bearing 51 to be pushed towards the apparatus axis A deeper into the guide aperture until seated in the aligned positioning aperture 31. This is the locking position of the mechanism 30 in this arrangement. Recesses or wells 45 formed in the grip 18 adjacent the outer surface 13A of the outer shaft limit upward sliding movement of the carrier 36.

Figures 16A, 16B, 16C:
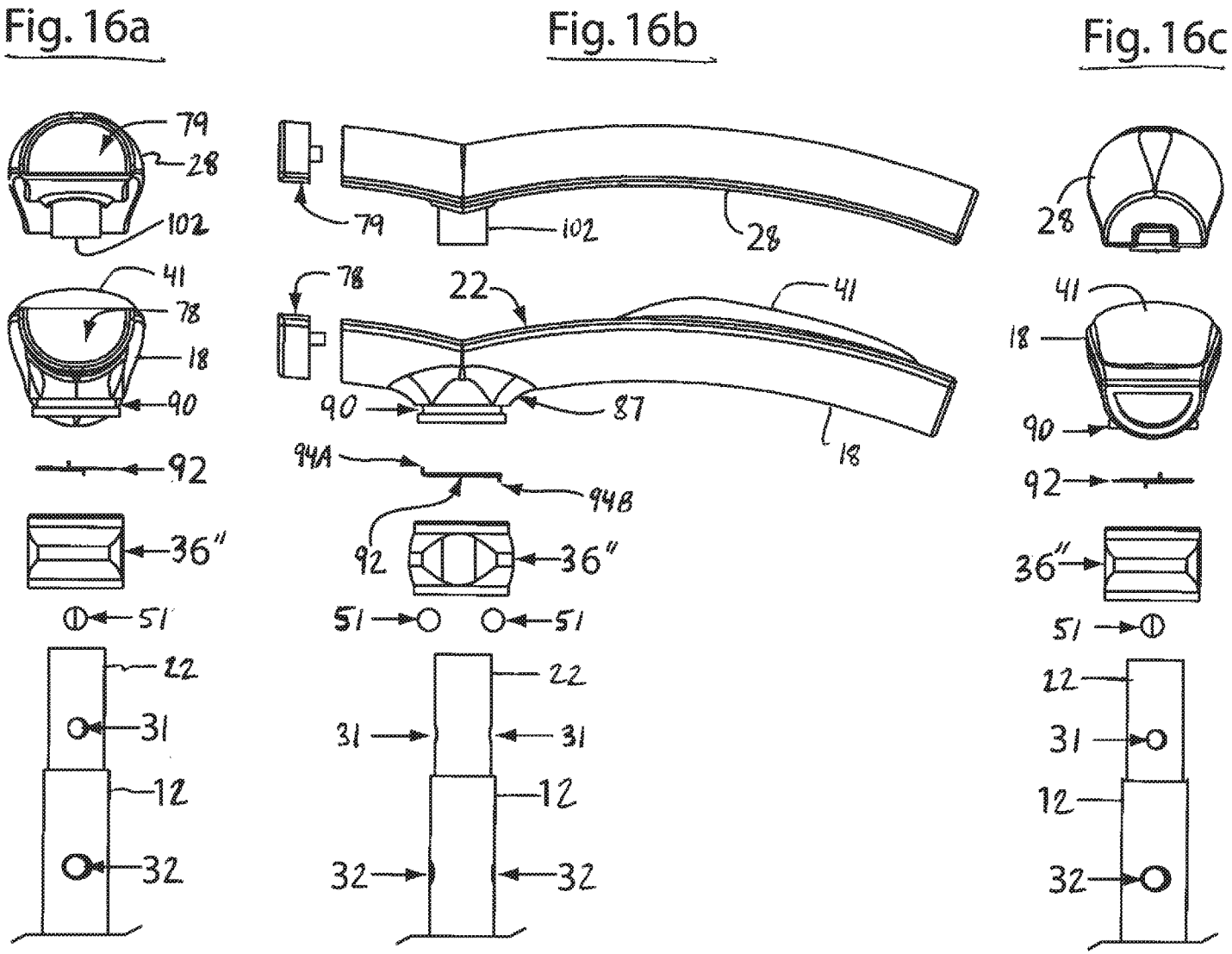
FIGS. 16*a*-16*c* are exploded views of the apparatus in front elevation, side elevation, and rear elevation, respectively.
Figure 17A:
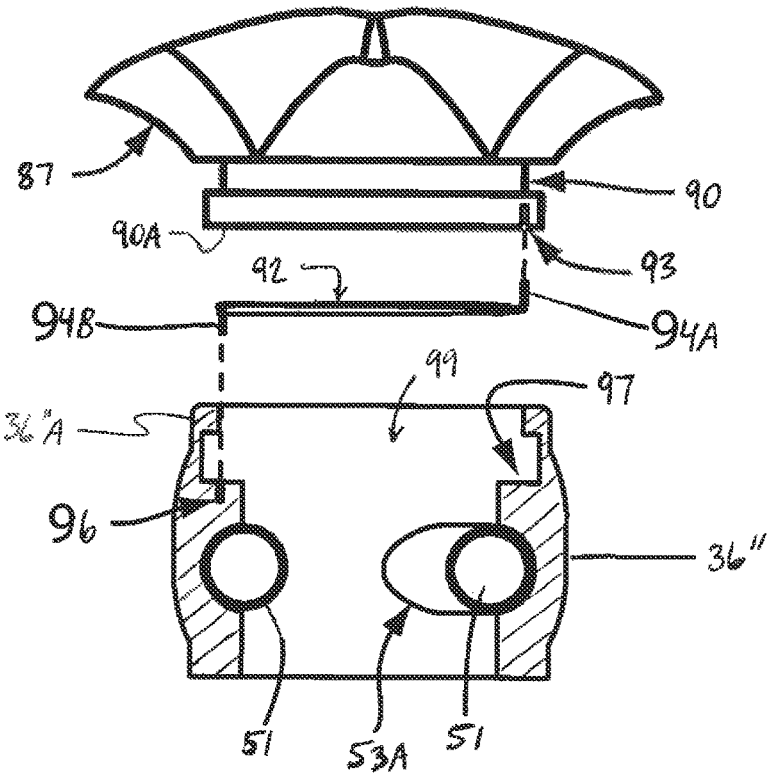
FIG. 17*a* illustrates the locking mechanism of the apparatus of FIGS. 16*a*-16*c* where a carrier thereof is shown in cross-section along line 17*a*-17*a* in FIG. 15*a*.
Figure 17B:
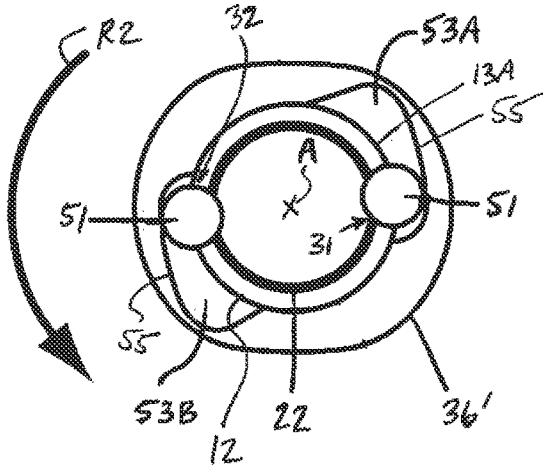
FIGS. 17*b* and 17*c* illustrate operation of the second arrangement of carrier each as if viewed along line 17*b*-17*b* in FIG. 14*b;*
Figure 17C:
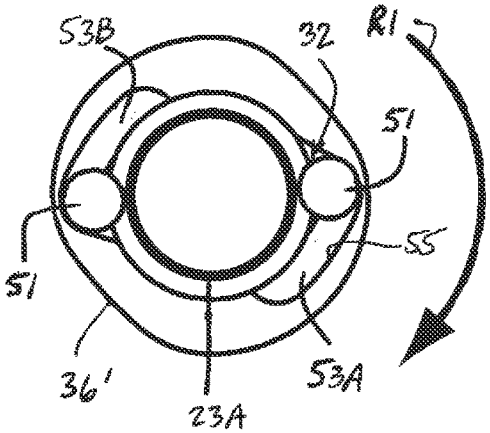

In a second arrangement of the locking mechanism as shown in FIGS. 16 and 17 is provided a carrier 36' also shaped to encompass the outer shaft 12 and which is arranged for rotating movement axially about the outer shaft between the locking and unlocked positions of the mechanism 30. This second arrangement is similar to the first having carrier with axially extending cavities except that this second arrangement of carrier 36' includes angularly extending cavities 53A and 53B. Each such cavity 53A, 53B has an arcuate outer wall 55 distal to the outer shaft 12 that generally follows curvature of the outer surface 13A thereof while also extending radially outwardly away from the outer surface 13A such that there is provided more space between the outer wall and the outer shaft at one end of the respective cavity 53A, 53B and less space at the other end thereof. The locking and unlocked positions of the mechanism 30 are otherwise achieved in a similar manner, that is rotating the carrier 36' as in direction R1 to present that part of the cavity having more space so that the bearing is not biased into a positioning aperture 31 and can roll freely between the inner shaft 12 and the outer wall 55 of the respective cavity and rotating in direction R2 to present that part of the cavity having less space so that the bearing is urged into seating engagement with the aligned positioning aperture.

Figures 9A, 9B, 9C:
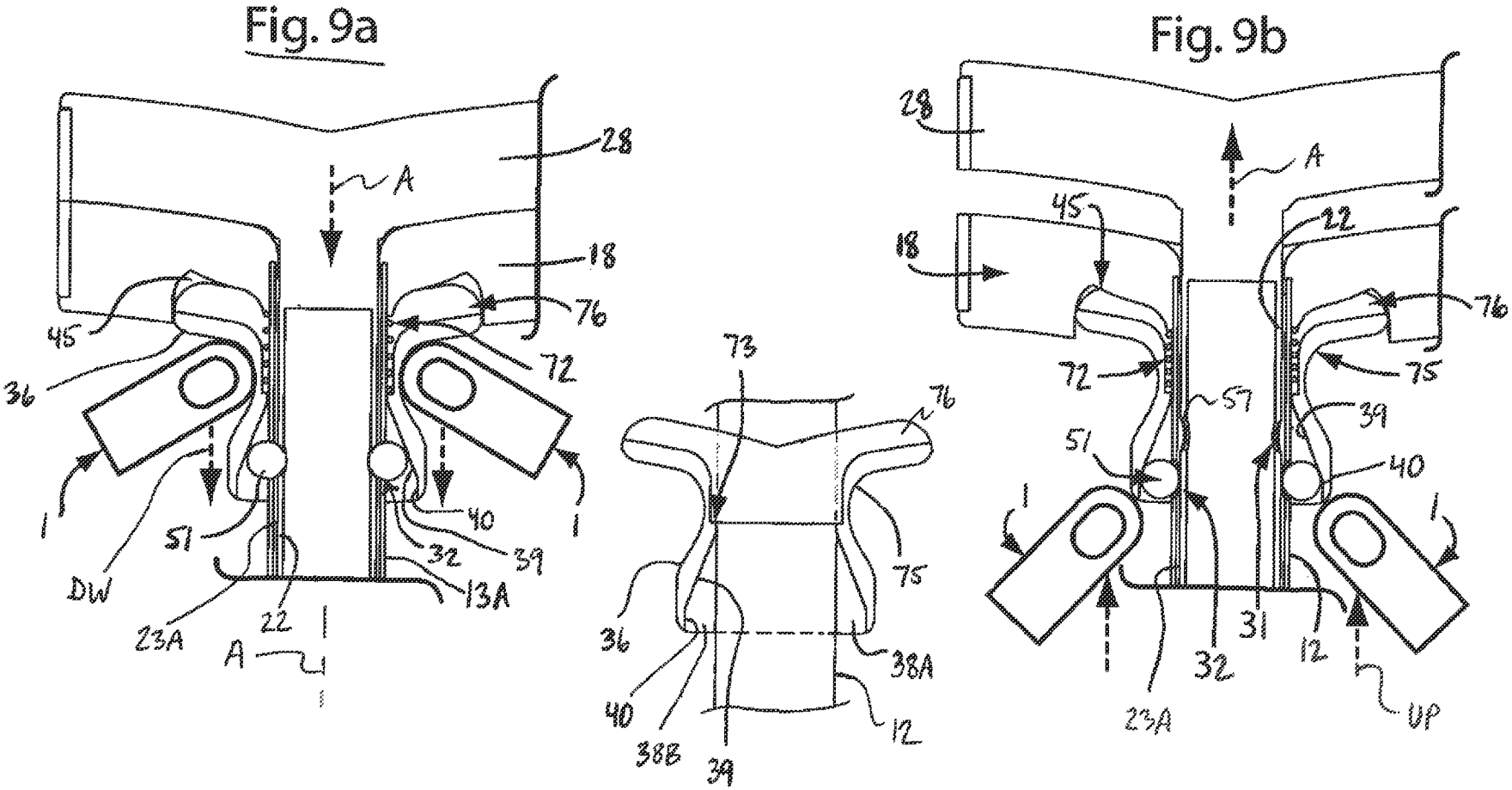
FIG. 9*a* illustrates in an enlarged vertical cross-section as if it were taken along line 6-6 in FIG. 1*b* the first arrangement of carrier as it is being locked.
FIG. 9*b* illustrates in an enlarged vertical cross-section like FIG. 9*a* the first arrangement of carrier as it is being unlocked.
FIG. 9*c* illustrates the first arrangement of carrier with a portion thereof cutaway.

In these arrangements of locking mechanism having rollable bearings, at an edge defining each one of the positioning apertures 31 of the inner shaft there is formed a ramped surface 57 as more clearly shown in FIG. 9*b* upon which the bearing may roll out of seated position in the respective positioning aperture. That is the ramped surface 57 extending circumferentially around the respective positioning aperture is shaped so as to diverge in a direction (radially) outwardly away from the apparatus axis A.

Furthermore, the positioning and guide apertures 31 and 32 are diametrically sized in a graduated manner such that the rollable bearings are limited in inward range of movement towards the apparatus axis A. That is the positioning apertures are sized in diameter to be slightly smaller than the guide apertures so that the bearings may be seated sufficiently deeply in the inward direction towards the apparatus axis A so as to be able to hold the inner shaft 22 securely in the locking position while still being able to move out of seated engagement in the respective positioning aperture.

Figure 18:
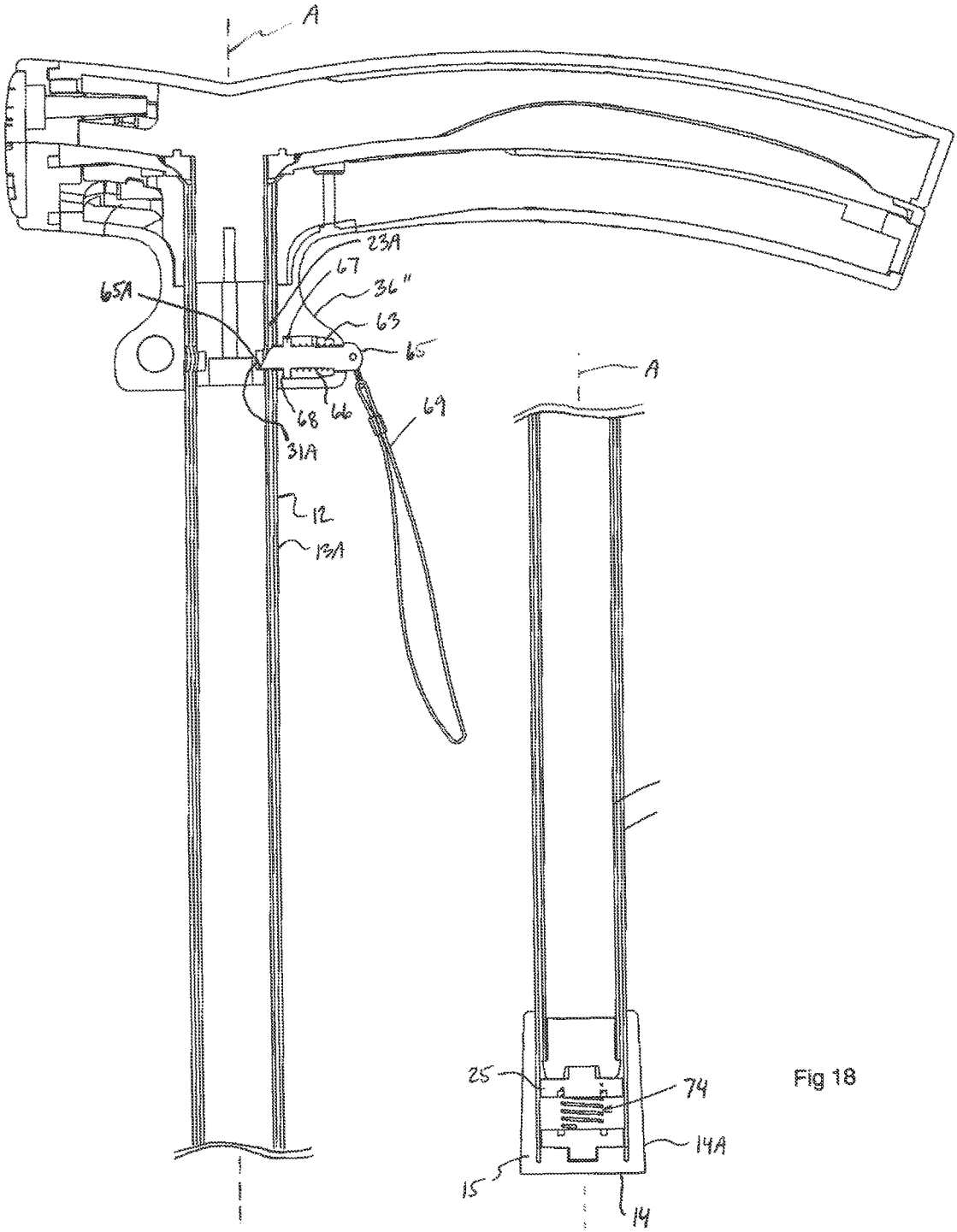
FIG. 18 illustrates in vertical cross-section as if it were taken along line 6-6 in FIG. 1*b* another arrangement of locking mechanism in which the inner and outer shafts are shown in the cane configuration.
Figure 19:
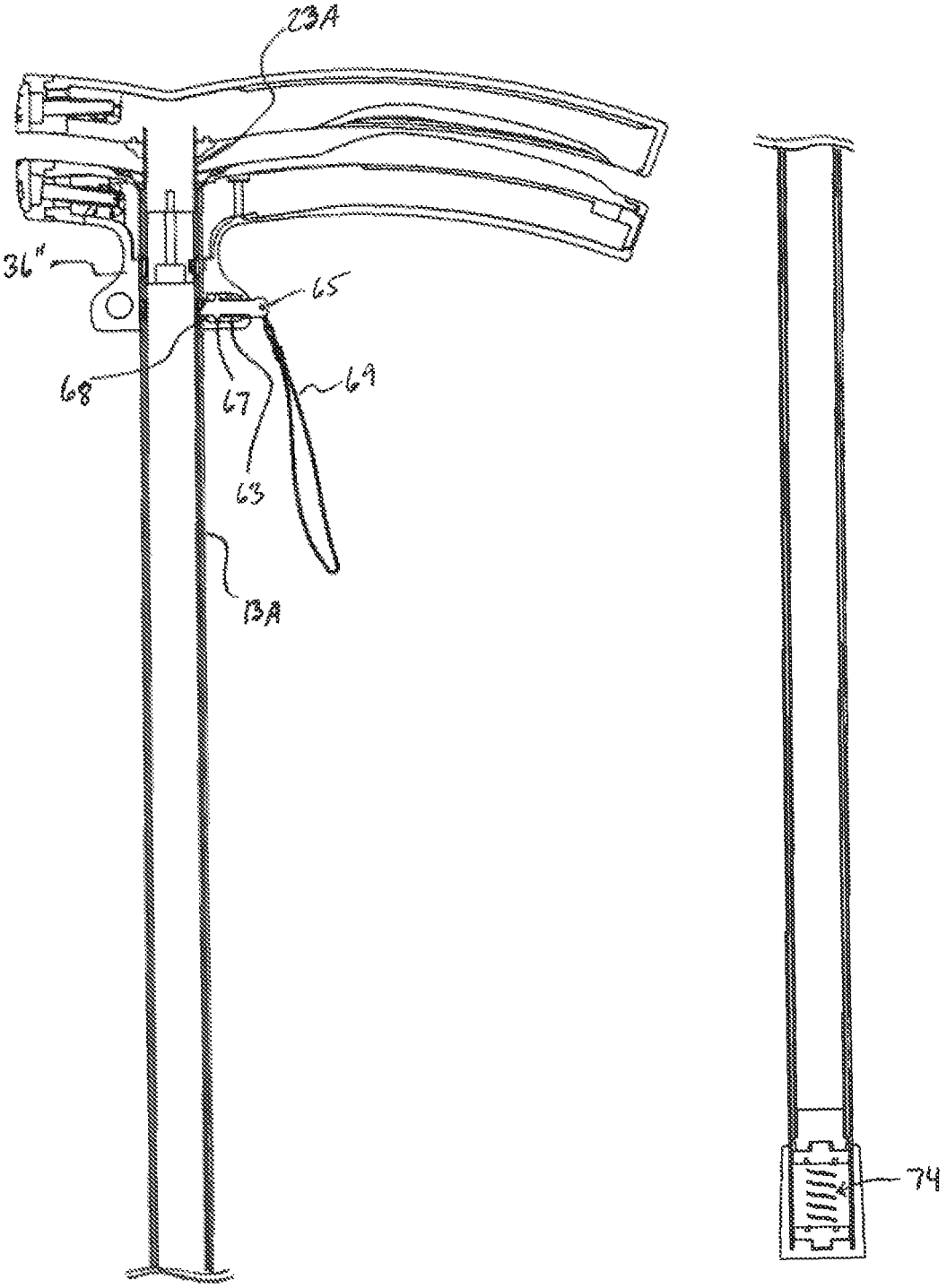
FIG. 19 illustrates the apparatus as shown in FIG. 18 where a retention element of the third arrangement of locking mechanism is not seated in an aperture in the inner shaft.
Figure 20:
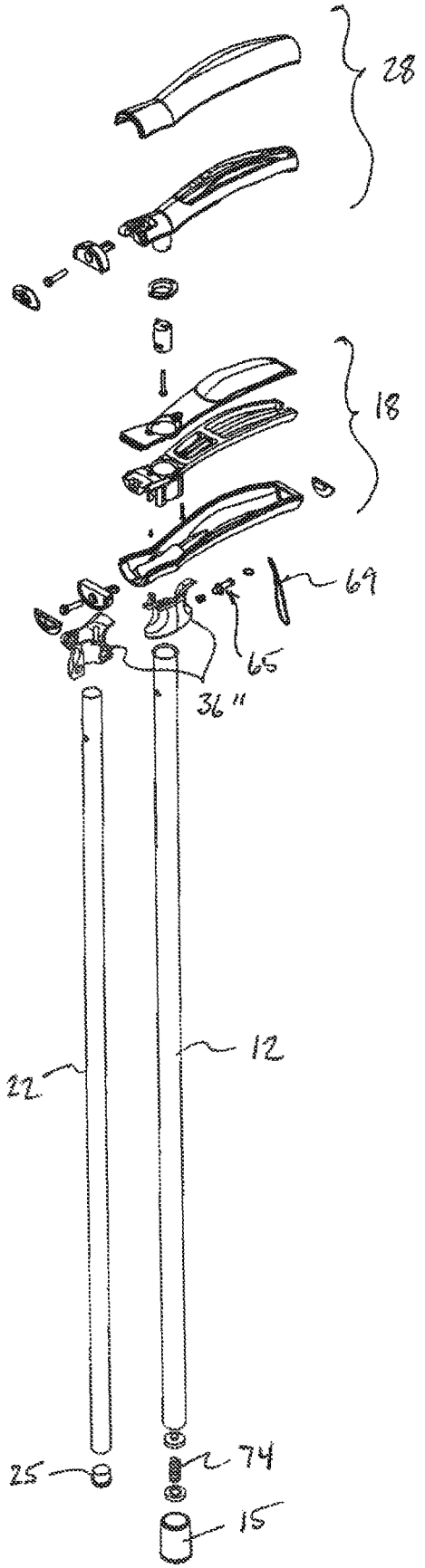
FIG. 20 illustrates the apparatus as shown in FIG. 18 in an exploded view.

In a third arrangement of locking mechanism the carrier supporting the retention element comprises a biasing element 59 located inside an at least partially hollowed portion 27 of the inner shaft. The retention element comprises a button 61 and the biasing element, which is a "V" compression spring in the illustrated arrangement, is arranged so as to bias the button in a (radially) outwardly direction. In this arrangement the retention element is located in fixed location to the inner shaft and is passed through one positioning aperture 31 in a position ready for seating in one guide aperture 32. In an arrangement of the apparatus having only this arrangement of locking mechanism a plurality of guide apertures such as those indicated 32E and 32F in FIGS. 18 and 19 are provided so that the apparatus can be arranged in various configurations for pointing the grips 18, 28 in the same or different directions and in extended or nesting configurations. The button 61 is accessible at an outside of the outer shaft 12 so that the button can be pushed inwardly out of seated engagement with the respective guide aperture 32 into the unlocking position in which an outer face 62A of the button, which otherwise protrudes beyond the outer surface 13A of the outer shaft in the locked position, slides along an inside surface 13B of the outer shaft while the apparatus is arranged in the desired configuration. The button includes at its end proximal the biasing element a peripheral flange 62B projecting transversely outwardly relative to the direction in which the button 61 is biased so that this stopping flange 62B engages an inner surface 23B of the inner shaft in the unlocking position thereby limiting how far the button is seated in the respective guide aperture in the locked position. In a further arrangement of the locking mechanism there is provided a carrier 36" carried externally of the outer shaft 12 with a radially extending cavity 63 within which the retention element is carried for its movement between the locking and unlocked positions. In this arrangement the retention element comprises a pin 65 which is biased in a direction radially inwardly towards the axis A by a biasing arrangement 66, such as a compression spring, located outside the outer shaft 12. A stop is provided for abutting the pin 65 so as to limit a depth of insertion of the pin into aligned ones of the positioning and the guide apertures. For example the stop may be formed by a base 31A of the respective positioning aperture that is recessed from the surface 23A of the inner shaft, and/or by a flange 67 extending radially of the pin for abutting an inner cavity wall 68 proximal the outer shaft.

The pin 65 is accessible externally of the carrier 36" by a gripping device 69 such as a lanyard so that the pin may be pulled away from the apparatus axis A into the unlocked position. The biasing arrangement 66 urges the pin radially inwardly towards the inner shaft so that the pin is readied for the locking position. An inside tip 65A of the pin may slide across the surface 23A of the inner shaft, at which the positioning aperture is communicable with the respective guide aperture, as the apparatus is arranged in the desired configuration.

An outer covering may be receiving on each of the shafts so that in the case of the outer shaft 12 its outer surface 13A is covered thereby and the surface 23A of the inner shaft is covered thereby. The outer coverings of the shafts may have different colours, and the outer coverings may be replaced by coverings with other colours. This may allow the user to personalize to the apparatus 10 to his/her liking.

Further details of the illustrated arrangements are now described.

Note that for convenience of reference in this specification the apparatus 10 may be referred to as 'Versatile Lockable Nesting Canes' or the '2Cane'. This is because the outer shaft 12 and its grip 18 in effect collectively form a first outer cane CO and the inner shaft 22 and the grip 28 coupled thereto in effect collectively form a second inner cane CI. As already described herein these two canes CO, CI are interconnectable in a plurality of configurations to provide an apparatus which can be arranged to operate as a single cane, a crutch, or a prop for helping a user stand up.

Referring to FIG. 1*a* there is illustrated a side view of the Versatile Lockable Nesting Canes (a.k.a. the "2Cane") 10 in its locked single cane configuration in which the only visible part of the inner cane CI is its top grip 28 while a remainder of the inner cane is covered by the outer cane CO.

In FIG. 3*a* the inner cane CI is illustrated in a position in which the inner cane can be inserted into the outer cane 14.

Figure 6B:
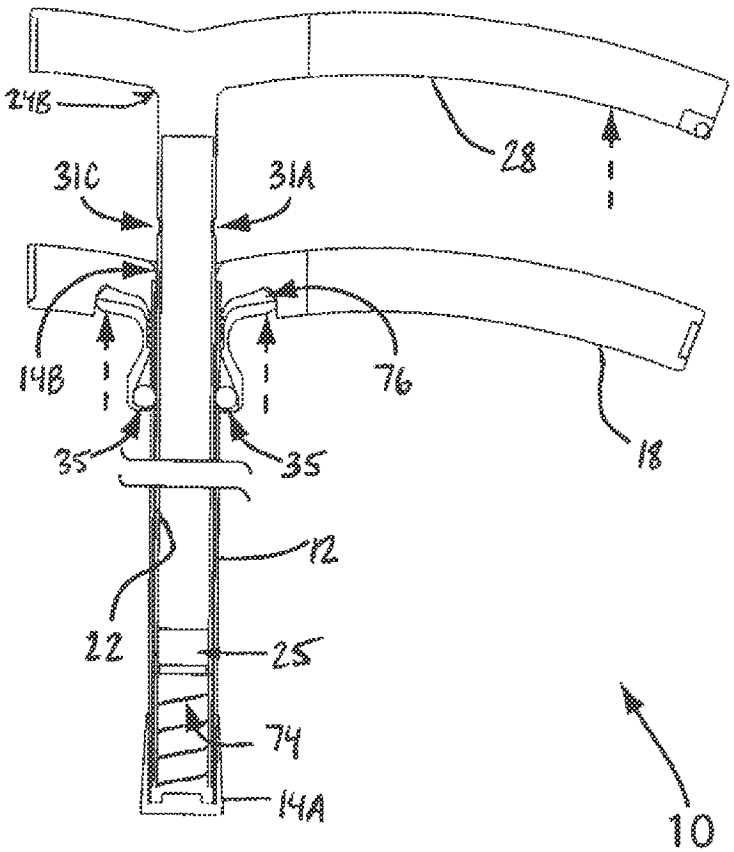
FIG. 6*b* shows the same view with a locking mechanism positioned so as to allow the inner shaft to be removed from the outer shaft into the extended configuration.
Figure 6A:
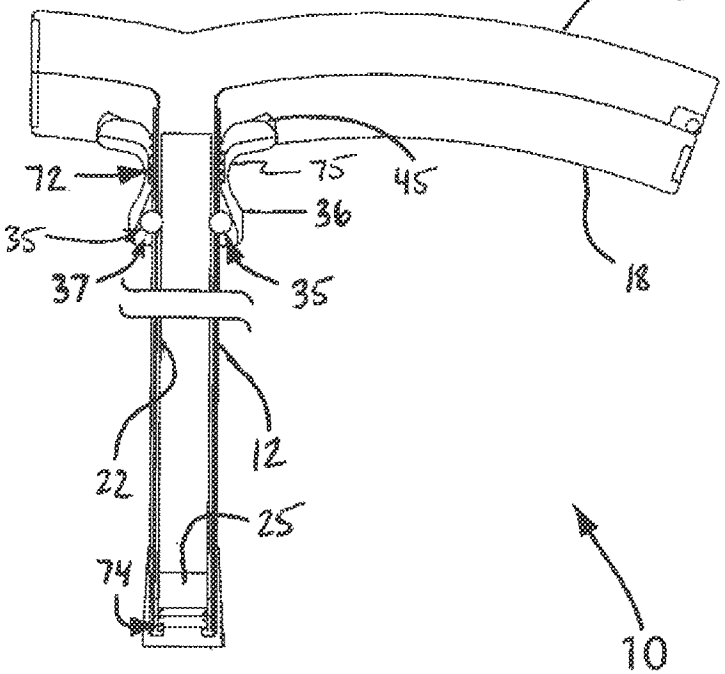
FIG. 6*a* illustrates in vertical cross-section along line 6-6 in FIG. 1*b* the apparatus in a cane configuration.

FIG. 6*a* shows the inner cane CI locked into the outer cane CO in the nested cane configuration. In FIG. 6*b* the carrier 36 has been pressed upwards so as to release the inner cane CI to allow the apparatus 10 to be arranged in a different configuration. In FIG. 6*a* is shown a carrier biasing arrangement such as a compression spring 72 located externally of the outer shaft 12 and arranged to bias the carrier 36 to the locking position of the mechanism. The carrier biasing spring 72 is attached at one end to the outer shaft 12 and at the opposite end to the carrier 36 at a shelf 73. FIG. 6*b* shows the inner cane CI released from being secured in fixed relation to the outer shaft as the top 24B of the inner shaft is urged past the top 14B of the outer shaft by the compression spring 74. Thus upon moving the carrier to the unlocked position the spring 74 which is otherwise compressed in the nested configurations of the apparatus is no longer resisted from urging the inner shaft upwardly, and thus the spring 74 is able to push the inner shaft axially in a direction outwardly from the top 14B of the outer shaft by which the bearings 51 are unseated from the initially aligned positioning apertures. The carrier 36 is shaped so as to include depressions 75 suitable for receiving the user's fingers 1 above which the carrier is flared at 76 so that there is provided a downward facing surface where the user's hand can be located in moving the carrier upwardly to into the unlocked position of the mechanism.

FIG. 7 additionally illustrates grip endcaps 78 and 79 for the outer shaft's and inner shaft's grips which attach thereto at the respective smaller portions and endcap covers 81 and 82 which connect to the respective endcap at its end distal to the respective shaft.

FIGS. 8*a*-8*f* more clearly illustrate the carrier 36 which has a central hollow 85 spanning axially through the carrier so that the carrier can be received over the outer shaft 12 as for example shown in FIG. 7. The carrier 36 includes the shelf 73 whereat the carrier biasing spring 72 couples to the carrier, whether by resting against a support surface defined by the shelf that is oriented to lie in the orthogonal radial plane to the apparatus axis A or by fastening to the carrier at this shelf. The hollow 85 is shaped so as to include portions thereof forming the cavities 38A and 38B when the carrier is received over the outer shaft 12.

In FIG. 17*a* is more clearly shown the second arrangement of carrier 36' which is supported for rotational movement about the apparatus axis A by a carrier base 87 coupling to the outer shaft for example by attachment at the recesses 45 in a bottom of the outer shaft's grip 18. The carrier base 87 has a central hollow 89 so that it can be received over the outer shaft 12 and includes a depending neck 90. In this arrangement the carrier biasing arrangement which biases the carrier 36' to the locking position comprises a torsion spring 92 which is located externally of the outer shaft 12 so as to encompass same. A slot 93 in a bottom face 90A of the neck for receives one end 94A of the torsion spring which remains in fixed relation to the outer shaft as the carrier base 87 does not rotate, rather the base is fixed relative to the outer shaft. Another end 94B of the spring is connected in a slot 96 which is in a shelf 97 of the carrier 36' upon which the torsion spring is substantially rested. The carrier 36' which has a central hollow 99 so that it can be received over the outer shaft is shaped at a top of the hollow 99 proximal the grip 18 to cooperatively mate with the depending neck 90 of the carrier base. As such the carrier 36' is maintained at a fixed axial location along the outer shaft by this connection via the neck 90 of the base 87 while still being able to rotate between the locking and unlocked positions of the locking mechanism. When the carrier 36' is rotated in the rotational direction R1 towards the unlocked position the bearings 51 are allowed to retreat out of the aligned positioning apertures out of seated engagement therein. Upon rotating the carrier 36' in direction R1 the torsion spring 92 becomes twisted and acts to urge the carrier in the rotational direction R2 back to the locking position.

The outer and inner shafts may be wholly made from an appropriate metallic alloy which are sufficiently strong to carry weight of the user and which may resist damage if dropped onto the floor or the ground. Alternatively, the shafts may be substantially carbon fiber with a metallic alloy for example in the form of an insert reinforcing a respective one of the guide apertures and the positioning apertures where the apparatus experiences considerable wear with continued use.

The grips and the carrier may be made from polycarbonate, high strength plastic or similar material able to safely manage the loads encountered during use. Springs may be spring steel and the retention element of sufficient hardness to withstand repeated use. Covers on the bottoms of the shafts may be resilient material such as rubber or plastic.

It will be appreciated that the inner shaft may be hollow along its full length or include a hollow portion at the top 24B of the shaft so that the grip 28 which is coupled thereto is connected to the inner shaft by a plug 102 which snugly fits into an open top.

Also, it will be appreciated that the third arrangement of carrier 36" may also be used for redundancy, that is in addition to another carrier such as the first or the second arrangement, to hold the apparatus more securely in the desired on of the working configurations. This arrangement of carrier may also be included with its primary use for maintaining the apparatus in one of the extended working configurations.

In use, locking of the apparatus 10 into a desired one of the nested working configurations may be achieved simply with a single user action. That is, the user inserts the inner cane CI fully into the outer cane CO whereby the corresponding positioning apertures of the inner shaft 22 are aligned with the guide apertures of the outer shaft 12 having the retention element, that is the bearings 51, already seated therein. A wedging action of the respective inclined wall 39 on the respective bearing 51 effected by biasing of the carrier biasing spring 72 on the carrier 36 readies the bearings 51 for insertion into the positioning apertures once they are aligned with the guide apertures. This may be sufficient to ensure positive and secure locking of the inner shaft to the outer shaft into a nested working configuration.

By this downward action of the carrier 36, each inclined wall 39 of the carrier presses the respective bearing 51 through the guide aperture 32 in the outer shaft 12 and into seated engagement with the positioning aperture 31 in the inner shaft, thereby locking the inner cane 12 into the outer cane 14. The lock spring 38 which for example presses between an inside of the grip 18 coupled to the outer shaft and the spring shelf 73 acts to ensure that the carrier 36 remains in the locking position.

If alignment of the corresponding apertures alone does not allow the locking mechanism to enter the locking position, the user may pull the carrier 36 downwards in the direction DN which is the same direction in which the carrier is already biased by the spring 72 to manually force the respective bearing into the (nearly) aligned positioning aperture.

The locking mechanism enters the locking position in a similar manner for the apparatus in an extended working configuration although different corresponding sets of apertures on the inner and outer shafts are aligned with one another therefor.

For unlocking, the user moves the carrier 36 upwardly in a manner overcoming the carrier biasing compression spring 72, and the pressure of each inclined wall 39 acting on the respective bearing 51 is released so that each bearing 51 no longer has enough external force acting upon it to cause it mate with the aligned positioning aperture 31. Thus the inner shaft 22 is ejected from the nested configuration due to the force of the compression spring 74 located inside at the bottom of the outer shaft 12 that acts to in an upward axial direction.

The apparatus 10 may provide the flexibility that allows the user to participate in common tasks more fully, without the socially perceived stigma of inability. By this means, a person who would normally stay home because they don't want to be a bother to others because of their handicap, now has more self-confidence to go shopping, visit with friends, and take part in social activities because they are more mobile and can adapt to their situation because they have a mobility aid that is more versatile.

The multiple configurations of the 2Cane allow the user to adapt to the needs of their injuries. For example when the user begins to heal, the user can transition from using two canes, that is the apparatus in the separated configuration, to one cane, that is the apparatus in the nested cane configuration. In another example the user may transition from using the apparatus as a crutch (i.e., in the extended crutch configuration) to the apparatus arranged to form the single cane. It will be appreciated that the two canes provided by the apparatus in the separated configuration may be regarded as a "transition" between using a single cane and a conventional walker.

It will be appreciated that each of the outer and inner shafts may be formed at a height to suit the respective user depending on a desired overall height of the apparatus or a desired/suitable height for each of the inner and outer canes in the separated configuration.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An apparatus for aiding mobility of a user comprising:

an outer shaft which is hollow extending along an axis of the apparatus from a ground engaging end at a bottom of the outer shaft to a top end where there is located a grip projecting from the outer shaft transversely to the axis;

an inner shaft receivable in the outer shaft along said axis and having a bottom end locatable in the outer shaft at a location axially intermediate the top end and the ground engaging end and an upper end of the inner shaft at which there is located a grip located externally of the outer shaft that projects transversely from the inner shaft;

a locking mechanism for securing the inner shaft in fixed relation to the outer shaft so that the apparatus is usable in a plurality of configurations including:

a nested configuration in which the inner shaft is received substantially entirely in the outer shaft with the grip which is coupled to the inner shaft being located in contact with or immediately adjacent in close proximity to the grip coupled to the outer shaft;

an extended configuration in which the grip coupled to the inner shaft is spaced in an axial direction from the grip coupled to the outer shaft so that the inner shaft extends axially outwardly past the top end of the outer shaft;

the locking mechanism being formed by a plurality of apertures in the inner shaft and an aperture in the outer shaft where there is located a retention element for passing through said aperture and seating in one of the plurality of apertures in the inner shaft, such that:

(i) in the nested configuration a first one of the apertures in the inner shaft is aligned with the aperture axially and angularly of the axis so that the retention element is insertable therethrough for securing the inner and outer shafts in the nested configuration;

(ii) in the extended configuration a second one of the apertures in the inner shaft, which in relation to the first aperture is closer to the bottom end of the inner shaft, is aligned with the aperture axially and angularly of the axis so that the retention element is insertable therethrough for securing the inner and outer shafts in the extended configuration.

2. The apparatus according to claim 1 wherein the nested configuration comprises a cane configuration in which the grip which is coupled to the inner shaft and that coupled to the outer shaft are in abutment one top of the other and projecting from the apparatus axis in a common direction so as to collectively form a cane handle which is contiguous about its circumference.

3. The apparatus according to claim 2 wherein the grip which is coupled to the outer shaft includes a ridge and the grip which is coupled to the inner shaft includes a cooperative recess for matingly receiving the ridge so as to resist pivoting of the inner shaft relative to the outer shaft in the cane configuration.

4. The apparatus according to claim 1 wherein the nested configuration comprises a two handled configuration in which the grip which is coupled to the inner shaft and that coupled to the outer shaft project from the apparatus axis in different transverse directions so as to provide separate gripping surfaces each for one hand of the user.

5. The apparatus according to claim 1 wherein the extended configuration comprises a crutch configuration in which the grip which is coupled to the inner shaft and that coupled to the outer shaft project from the apparatus axis in a common direction such that the grip coupled to the inner shaft is for resting against an arm pit of the user and the grip coupled to the outer shaft is for gripping with a hand of the user.

6. The apparatus according to claim 1 wherein the extended configuration comprises a two handled configuration in which the grip which is coupled to the inner shaft and that coupled to the outer shaft project from the apparatus axis in different transverse directions for providing separate gripping surfaces each for one hand of the user at spaced positions angularly and axially of the axis.

7. The apparatus according to claim 1 wherein the retention element comprises a bearing supported for rolling movement in a cavity of a carrier which is carried externally of the outer shaft for movement relative thereto, the cavity of the carrier being shaped so that in a locking position the bearing is held in a location relative to the apparatus axis at which the bearing is seated in one of the apertures of the inner shaft and in an unlocking position the bearing is enabled to roll along a surface of the inner shaft.

8. The apparatus according to claim 7 wherein the carrier is slidable axially along the outer shaft.

9. The apparatus according to claim 7 wherein the carrier is rotatable axially about the outer shaft.

10. The apparatus according to claim 7 wherein at an edge defining each one of the apertures in the inner shaft there is formed a ramped surface upon which the bearing may roll out of seated position in the respective aperture in the inner shaft.

11. The apparatus according to claim 1 wherein the retention element comprises a projecting element carried by a biasing element which is supported at a fixed location inside the inner shaft arranged to bias the projecting element outwardly from the apparatus axis.

12. The apparatus according to claim 1 wherein the retention element comprises a pin biased by an arrangement located outside the outer shaft in a direction inwardly towards the apparatus axis.

13. The apparatus according to claim 1 being further configurable a separated configuration in which the inner shaft is wholly outside of the outer shaft such that the inner shaft and grip coupled thereto and the outer shaft and grip coupled thereto each form a separate cane for use in a respective hand of the user.

* * * * *